US011257430B2

(12) United States Patent
Yamamoto

(10) Patent No.: US 11,257,430 B2
(45) Date of Patent: Feb. 22, 2022

(54) DRIVE METHOD AND DISPLAY DEVICE

(71) Applicant: SHARP KABUSHIKI KAISHA, Sakai (JP)

(72) Inventor: Keiichi Yamamoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/043,574

(22) PCT Filed: Mar. 29, 2018

(86) PCT No.: PCT/JP2018/013251
§ 371 (c)(1),
(2) Date: Sep. 29, 2020

(87) PCT Pub. No.: WO2019/186895
PCT Pub. Date: Oct. 3, 2019

(65) Prior Publication Data

US 2021/0020102 A1 Jan. 21, 2021

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2360/16* (2013.01)

(58) Field of Classification Search
CPC ..... G09G 2360/16; G09G 2320/043; G09G 2320/045
See application file for complete search history.

(56) References Cited

U.S. PATENT DOCUMENTS

2005/0110786 A1 5/2005 Inoue et al.
2007/0132674 A1* 6/2007 Tsuge ..... G09G 3/3283 345/77
2008/0186258 A1 8/2008 Ishimoto et al.
2012/0138922 A1 6/2012 Yamazaki et al.
2013/0214273 A1 8/2013 Yamazaki et al.
(Continued)

FOREIGN PATENT DOCUMENTS

CN 107111986 A 8/2017
JP 2000-019484 A 1/2000
(Continued)

*Primary Examiner* — Sepehr Azari
(74) *Attorney, Agent, or Firm* — ScienBiziP, P.C.

(57) ABSTRACT

A drive method according to the disclosure includes a target row determination step of determining a target row to which a target pixel for which a characteristic of at least one of a drive transistor and an electro-optical element is detected belongs, a luminance calculation step of calculating a representative luminance of a pixel in the target row, and a detection determination step of performing a characteristic detection step of detecting monitoring data indicating the characteristic of at least one of the drive transistor and the electro-optical element of the pixel belonging to the target row in a case where the representative luminance is greater than or equal to a threshold, and skipping the characteristic detection step in a case where the representative luminance is less than the threshold.

16 Claims, 20 Drawing Sheets

(56) References Cited

U.S. PATENT DOCUMENTS

| | | | | |
|---|---|---|---|---|
| 2014/0152633 | A1* | 6/2014 | Park | G09G 3/3291 345/207 |
| 2014/0183532 | A1 | 7/2014 | Yamazaki et al. | |
| 2015/0179805 | A1 | 6/2015 | Yamazaki et al. | |
| 2015/0243226 | A1* | 8/2015 | Kumeta | G09G 3/3233 345/207 |
| 2015/0339977 | A1* | 11/2015 | Nathan | G09G 3/3291 345/78 |
| 2015/0379940 | A1* | 12/2015 | Kishi | G09G 3/3283 345/690 |
| 2016/0104422 | A1* | 4/2016 | Kishi | G09G 3/006 345/205 |
| 2016/0155377 | A1* | 6/2016 | Kishi | G09G 3/3233 345/214 |
| 2016/0240694 | A1 | 8/2016 | Yamazaki et al. | |
| 2016/0300534 | A1* | 10/2016 | Kishi | G09G 3/3283 |
| 2017/0025061 | A1* | 1/2017 | Takizawa | G09G 3/3291 |
| 2017/0309754 | A1 | 10/2017 | Yamazaki et al. | |
| 2017/0372656 | A1 | 12/2017 | Furukawa et al. | |
| 2018/0308989 | A1 | 10/2018 | Yamazaki et al. | |

FOREIGN PATENT DOCUMENTS

| | | | |
|---|---|---|---|
| JP | 2005-107059 | A | 4/2005 |
| JP | 2008-191353 | A | 8/2008 |
| JP | 2012-134475 | A | 7/2012 |
| WO | 2012/073844 | A1 | 6/2012 |
| WO | 2014/208458 | A1 | 12/2014 |

* cited by examiner

| | CHARACTERISTIC DETECTION DETERMINATION OPERATION | NORMAL OPERATION |
|---|---|---|
| (k + 1)-TH FRAME | FIRST ROW | SECOND TO n-TH ROWS |
| (k + 2)-TH FRAME | SECOND ROW | FIRST ROW, AND THIRD TO n-TH ROWS |
| (k + 3)-TH FRAME | THIRD ROW | FIRST AND SECOND ROWS, AND FOURTH TO n-TH ROW |
| ⋮ | ⋮ | ⋮ |
| (k + n)-TH FRAME | n-TH ROW | FIRST TO (n - 1)-TH ROWS |

FIG. 3

| NORMAL DISPLAY DATA | NORMALIZED LUMINANCE | NORMALIZED LUMINANCE - 0.408 | CONVERTED DISPLAY DATA |
|---|---|---|---|
| 0 | 0 | | |
| 1 | 0.0005 | | |
| 2 | 0.0023 | | |
| 3 | 0.0056 | | |
| 4 | 0.0107 | | |
| 5 | 0.0175 | | |
| 6 | 0.0261 | | |
| 7 | 0.0367 | | |
| 8 | 0.0492 | | |
| 9 | 0.0638 | | |
| 10 | 0.0804 | | |
| 11 | 0.0992 | | |
| 12 | 0.1201 | | |
| 13 | 0.1433 | | |
| 14 | 0.1686 | | |
| 15 | 0.1963 | −0.0036 | |
| 16 | 0.2262 | −0.1817 | |
| 17 | 0.2585 | −0.1494 | |
| 18 | 0.2932 | −0.1147 | |
| 19 | 0.3302 | −0.0777 | |
| 20 | 0.3697 | −0.0382 | |
| 21 | 0.4116 | 0.0036 | 2 |
| 22 | 0.4559 | 0.0479 | 7 |
| 23 | 0.5028 | 0.0948 | 10 |
| 24 | 0.5521 | 0.1441 | 13 |
| 25 | 0.6040 | 0.1960 | 14 |
| 26 | 0.6584 | 0.2504 | 16 |
| 27 | 0.7155 | 0.3075 | 18 |
| 28 | 0.7751 | 0.3671 | 19 |
| 29 | 0.8373 | 0.4293 | 21 |
| 30 | 0.9021 | 0.4941 | 22 |
| 31 | 0.9696 | 0.5616 | 24 |
| 32 | 1.0397 | 0.6317 | 25 |

FIG. 21

DRIVE METHOD AND DISPLAY DEVICE

TECHNICAL FIELD

The disclosure relates to a drive method for a display device and the display device.

BACKGROUND ART

A display device using organic Electro Luminescence (EL) elements (also called Organic Light-Emitting Diodes (OLEDs)) has been developed in the related art.

For such a display device, a thin film transistor (TFT) is typically employed as a drive transistor. However, variations are likely to occur in characteristics of the thin film transistor. Specifically, variations are likely to occur in a threshold voltage or a mobility. If variations occur in a threshold voltage or a mobility of a drive transistor provided in a display portion, variation occurs in luminance, which lowers display quality. Furthermore, with respect to the organic EL elements, current efficiency (light emission efficiency) decreases over time. Thus, luminance gradually decreases over time even when a constant current is supplied to the organic EL elements.

To deal with the problems described above, PTL 1 discloses a technique for correcting driving of OLEDs by displaying frames of an inspection pattern at a rate of one frame for one second and measuring a current.

CITATION LIST

Patent Literature

PTL 1: JP 2005-107059 A (published on Apr. 21, 2005)

SUMMARY

Technical Problem

However, the technology described above has a problem in that light emission of OLEDs in an inspection is easily visually recognized by viewers.

In light of the above problems, an objective of the disclosure is to provide a technology in which light emission of OLEDs in an inspection is unlikely to be visually recognized.

Solution to Problem

To solve the above-described problems, a drive method according to an embodiment is a drive method for a display device including a pixel matrix with n rows×m columns (n and m are integers greater than or equal to 2) including n×m pixel circuits, each pixel circuit includes an electro-optical element luminance of which is controlled by a current and a drive transistor configured to control a current to be supplied to the electro-optical element, the display device includes a scanning line provided for each of the rows, a monitoring line provided for each of the rows, and a data line provided for each of the columns, and the drive method is a method including a target row determination step of determining a target row to which a target pixel for which a characteristic of at least one of the drive transistor and the electro-optical element is detected belongs, a luminance calculation step of calculating a representative luminance of a pixel in the target row, and a detection determination step of performing a characteristic detection step of detecting monitoring data indicating the characteristic of at least one of the drive transistor and the electro-optical element of the pixel belonging to the target row in a case where the representative luminance is greater than or equal to a threshold, and skipping the characteristic detection step in a case where the representative luminance is less than the threshold.

In addition, a display device according to an embodiment is a display device including a pixel matrix with n rows×m columns (n and m are integers greater than or equal to 2) including n×m pixel circuits, each pixel circuit including an electro-optical element luminance of which is controlled by a current and a drive transistor configured to control a current to be supplied to the electro-optical element, the display device including a scanning line provided for each of the rows, a monitoring line provided for each of the rows, a data line provided for each of the columns, and a controller, and the controller is configured to determine a target row to which a target pixel for which a characteristic of at least one of the drive transistor and the electro-optical element is detected belongs, calculate a representative luminance of a pixel in the target row, and perform a characteristic detection step of detecting monitoring data indicating the characteristic of at least one of the drive transistor and the electro-optical element of the pixel belonging to the target row in a case where the representative luminance is greater than or equal to the threshold, and skipping the characteristic detection step in a case where the representative luminance is less than the threshold.

Advantageous Effects of Disclosure

According to the drive method and the display device described above, the effect that light emission of OLEDs in an inspection is unlikely to be visually recognized is exhibited.

BRIEF DESCRIPTION OF DRAWINGS

FIG. 3 is a diagram illustrating an execution order of a characteristic detection operation according to the first embodiment.

FIG. 21 is a diagram illustrating an example of a lookup table (LUT) according to the second embodiment.

DESCRIPTION OF EMBODIMENTS

First Embodiment

Embodiments of the disclosure will be described below with reference to the accompanying drawings. In the following description, although organic Electro Luminescence (EL) (also referred to as an Organic Light-Emitting Diode (OLED)) will be exemplified for an example of an electro-optical element, the present embodiment is not limited thereto, and a Quantum dot Light-Emitting Diode (QLED) may be used as the electro-optical element.

In addition, in the following description, m and n are assumed to be an integer greater than or equal to 2, i is assumed to be an integer greater than or equal to 1 and less than or equal to n, and j is assumed to be an integer greater than or equal to 1 and less than or equal to m. In addition, in the following description, a characteristic of a drive transistor provided in a pixel circuit is referred to as a "TFT characteristic," and a characteristic of an organic EL element provided in a pixel circuit is referred to as an "OLED characteristic."

1. Overall Configuration

Figure 1:
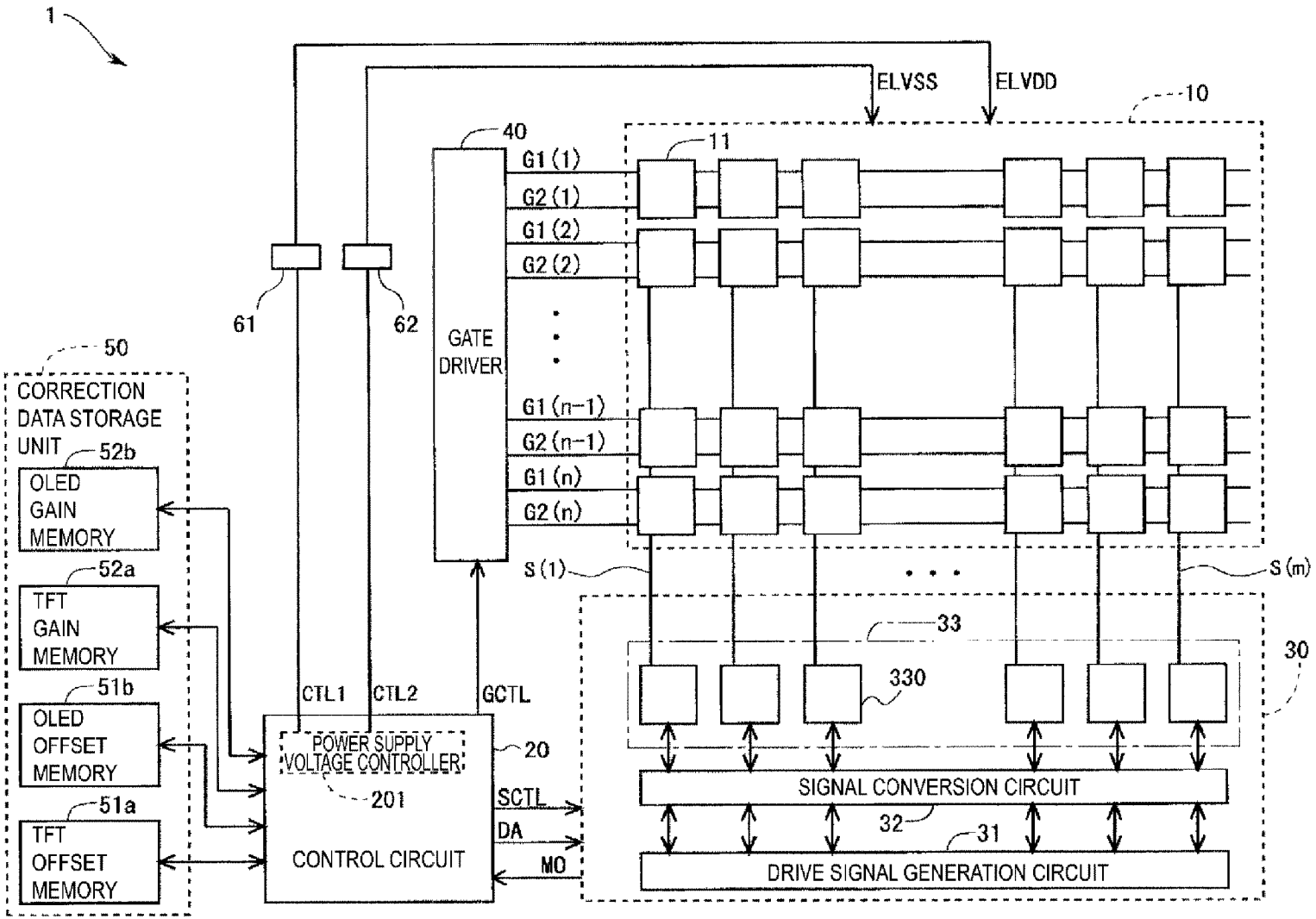
FIG. 1 is a block diagram illustrating an overall configuration of an active-matrix display device according to a first embodiment.

FIG. 1 is a block diagram illustrating an overall configuration of an active-matrix display device 1 according to an embodiment of the disclosure. The display device 1 includes a display portion 10, a control circuit (controller) 20, a source driver (data line drive circuit) 30, a gate driver (scanning line drive circuit) 40, a correction data storage unit 50, an organic EL high-level power supply 61, and an organic EL low-level power supply 62. Note that one or both of the source driver 30 and the gate driver 40 may be integrally formed with the display portion 10.

In the display portion 10, m data lines S(1) to S(m) and n scanning lines G1(1) to G1(*n*) orthogonal to these data lines are arranged. In the following, a direction in which the data lines extend is taken as a Y direction, and a direction in which the scanning lines extend is taken as an X direction. A constituent element along the Y-direction may be referred to as a "column" and a constituent element along the X direction may be referred to as a "row." Also, in the display portion 10, n monitoring control lines (also referred to simply as "monitoring lines") G2(1) to G2(*n*) are arranged to correspond to the n scanning lines G1(1) to G1(*n*) in a one-to-one manner. As an example, the scanning lines G1(1) to G1(*n*) and the monitoring control lines G2(1) to G2(*n*) are parallel to each other. Further, in the display portion 10, n×m pixel circuits 11 are provided to correspond to the intersections between then scanning lines G1(1) to G1(*n*) and m data lines S(1) to S(m). Because n×m pixel circuits 11 are provided as described above, a pixel matrix with n rows×m columns is formed in the display portion 10. In addition, in the display portion 10, a high-level power supply line that supplies a high-level power supply voltage ELVDD and a low-level power supply line that supplies a low-level power supply voltage ELVSS are arranged.

Note that, in the following, the data lines are simply denoted by reference sign S in a case in which there is no need to distinguish the m data lines S(1) to S(m) from each other. Similarly, in a case in which there is no need to distinguish the n scanning lines G1(1) to G1(*n*) from each other, the scanning lines are simply denoted by reference sign G1, and in a case in which there is no need to distinguish the n monitoring control lines G2(1) to G2(*n*) from each other, the monitoring control lines are simply denoted by reference sign G2.

The data lines S in the present embodiment are used not only as signal lines that transmit luminance signals for causing the organic EL elements in the pixel circuit 11 to emit light with desired luminance, but also as signal lines to apply a control potential for detecting TFT characteristics or OLED characteristics to the pixel circuits 11 and signal lines serving as paths for currents indicating TFT characteristics or OLED characteristics and currents measurable by output/current monitoring circuits 330, which will be described later.

The control circuit 20 controls an operation of the source driver 30 by providing a data signal DA and a source control signal SCTL to the source driver 30, and controls an operation of the gate driver 40 by providing a gate control signal GCTL to the gate driver 40. The source control signal SCTL includes, for example, a source start pulse, a source clock, a latch strobe signal, and the like. The gate control signal GCTL includes, for example, a gate start pulse, a gate clock, an output enable signal, and the like. In addition, the control circuit 20 receives monitoring data MO provided from the source driver 30, and updates correction data stored in the correction data storage unit 50. Note that the monitoring data MO is data measured to obtain a TFT characteristic or an OLED characteristic.

The control circuit 20 includes a power supply voltage controller 201. The power supply voltage controller 201 provides a voltage control signal CTL1 to the organic EL high-level power supply 61 to control a value of the high-level power supply voltage ELVDD output from the organic EL high-level power supply 61, and provides a voltage control signal CTL2 to the organic EL low-level power supply 62 to control a value of the low-level power supply voltage ELVSS output from the organic EL low-level power supply 62.

The gate driver 40 is connected to the n scanning lines G1(1) to G1(*n*) and the n monitoring control lines G2(1) to G2(*n*). The gate driver 40 is constituted by a shift register, a logic circuit, and the like. Meanwhile, in the display device 1 according to the present embodiment, an image signal sent from outside (data that is a source of the data signal DA) is corrected based on TFT characteristics and OLED characteristics. In this regard, in the present embodiment, a characteristic detection determination process is performed for one row in each frame. Here, as will be described in detail below, the characteristic detection determination process includes processes of:

determining whether to perform a characteristic detection process for one of the above-described rows; and performing the characteristic detection process for the one row if the characteristic detection process is determined to be performed, and skipping the characteristic detection process for the one row if the characteristic detection process is determined not to be performed. In addition, in the characteristic detection process, at least one of a TFT characteristic and an OLED characteristic is detected.

In the present embodiment, as an example, when the characteristic detection determination process is performed for a first row in a certain frame as described above, the characteristic detection determination process is performed for a second row in the next frame, and the characteristic detection determination process is further performed for a third row in the frame after the next frame. In this manner, target rows of the characteristic detection determination process for n rows are sequentially selected over an n-frame period, However, the process of sequentially selecting target rows as described above does not eliminate consecutive selection of the same row multiple times over a plurality of frames. For example, as will be described below in the present specification, in a case in which the characteristic detection process has not been performed for a certain row in a certain frame, the characteristic detection determination processing may be performed again for the certain row in the next frame. Furthermore, selection of a target row in the characteristic detection determination process is not limited to the sequential selection as described above, and rows may be selected at random as will be described below in the present specification.

In addition, the characteristic detection determination process may be performed in all frames to be displayed, or may be performed in some frames. Furthermore, a configuration in which the characteristic detection determination process is performed for each predetermined period of time may be adopted. For example, a configuration in which the characteristic detection determination process is applied to each row at a frequency of approximately one time an hour may be adopted, or a configuration in which the characteristic detection determination process is applied to all rows at a timing immediately after the display device 1 is turned on and a timing immediately before the display device 1 is turned off may be adopted.

Note that, in the present specification, a row that is subject to the characteristic detection determination process when focusing on any frame is referred to as a "monitoring row" or "target row," and a row other than a monitoring row is also referred to as a "non-monitoring row."

The source driver 30 is connected to m data lines S(1) to S(m). The source driver 30 is constituted by a drive signal generation circuit 31, a signal conversion circuit 32, and an output unit 33 including m output/current monitoring circuits 330. The m output/current monitoring circuits 330 in the output unit 33 are each connected to corresponding data lines S of the m data lines S(1) to S(m).

The drive signal generation circuit 31 includes a shift register, a sampling circuit, and a latch circuit. In the drive signal generation circuit 31, the shift register sequentially transfers source start pulses from an input terminal to an output terminal in synchronization with source clocks. In response to the transfer of the source start pulses, sampling pulses corresponding to each of the data lines S are output from the shift register. The sampling circuit sequentially stores the data signal DA for one row in accordance with timings of the sampling pulses. The latch circuit acquires and holds the data signal DA for one row stored in the sampling circuit in accordance with a latch strobe signal.

Note that, in the present embodiment, the data signal DA includes a luminance signal for causing the organic EL element of each pixel to emit light with desired luminance and a monitoring control signal for controlling the operation of the pixel circuit 11 when detecting the TFT characteristics and the OLED characteristics.

The signal conversion circuit 32 includes a D/A converter and an AID converter. As described above, the data signal DA for one row held in the latch circuit in the drive signal generation circuit 31 is converted to an analog voltage by the D/A converter in the signal conversion circuit 32. The converted analog voltage is provided to the output/current monitoring circuits 330 in the output unit 33. In addition, the signal conversion circuit 32 is provided with monitoring data MO from the output/current monitoring circuits 330 in the output unit 33. The monitoring data MO is converted from the analog voltage to a digital signal by the AID converter in the signal conversion circuit 32. Then, the monitoring data MO converted to the digital signal is provided to the control circuit 20 via the drive signal generation circuit 31.

An analog voltage Vs as a data signal DA is provided to the output/current monitoring circuit 330 from the signal conversion circuit 32. The analog voltage Vs is applied to the data lines S via buffers in the output/current monitoring circuits 330. In addition, the output/current monitoring circuits 330 have a function of measuring currents flowing in the data lines S. The data measured by the output/current monitoring circuits 330 is provided to the signal conversion circuit 32 as monitoring data MO. Note that a detailed configuration of the output/current monitoring circuits 330 will be described below.

The correction data storage unit 50 includes a TUFT offset memory 51*a*, an OLED offset memory 51*b*, a TFT gain memory 52*a*, and an OLED gain memory 52*b*. Note that these four memories may be physically one memory or may be physically different memories. The correction data storage unit 50 stores correction data used to correct an image signal sent from outside. Specifically, the TFT offset memory 51*a* stores an offset value based on the detection result of a TFT characteristic (the offset value is a value associated with a threshold voltage of the drive transistor) as correction data, The OLED offset memory 51*b* stores an offset value based on the detection result of an OLED characteristic (the offset value is a value associated with the light emission threshold voltage of the organic EL element)

as correction data. The TFT gain memory 52*a* stores a gain value based on the detection result of a TFT characteristic (the gain value is a value associated with the mobility of the drive transistor) as correction data. The OLED gain memory 52*b* stores a deterioration correction coefficient based on the detection result of an OLED characteristic as correction data. Note that, typically, numbers of offset values and gain values equal to the number of pixels in the display portion 10 are stored in the TFT offset memory 51*a* and the TFT gain memory 52*a*, respectively, as correction data based on the detection result of the TFT characteristic. In addition, typically, the numbers of offset values and deterioration correction coefficients equal to the number of pixels in the display portion 10 are stored in the OLED offset memory 51*b* and the OLED gain memory 52*b*, respectively, as correction data based on the detection result of the OLED characteristic. However, one value may be stored for each of a plurality of pixels in each memory.

As described above, the control circuit 20 updates the correction data based on the monitoring data MO. Specifically, the control circuit 20 updates the offset value in the TFT offset memory 51*a*, the offset value in the OLED offset memory 51*b*, the gain value in the TFT gain memory 52*a*, and the deterioration correction coefficient in the OLED gain memory 52*b* based on the monitoring data MO provided from the source driver 30. In addition, the control circuit 20 corrects an image signal so that the offset value in the TFT offset memory 51*a*, the offset value in the OLED offset memory 51*b*, the gain value in the TFT gain memory 52*a*, and the deterioration correction coefficient in the OLED gain memory 52*b* are read to compensate for the deterioration of the circuit element, Data obtained from the correction is sent to the source driver 30 as a data signal DA.

The organic EL high-level power supply 61 supplies the high-level power supply voltage ELVDD to the display portion 10. Note that a value of the high-level power supply voltage ELVDD is controlled based on the voltage control signal CTL1 output from the power supply voltage controller 201. The organic EL low-level power supply 62 supplies the low-level power supply voltage ELVSS to the display portion 10. Note that the value of the low-level power supply voltage ELVSS is controlled based on the voltage control signal CTL2 output from the power supply voltage controller 201.

2. Configuration of Pixel Circuit and Output/Current Monitoring Circuit

2.1 Pixel Circuit

Figure 2:
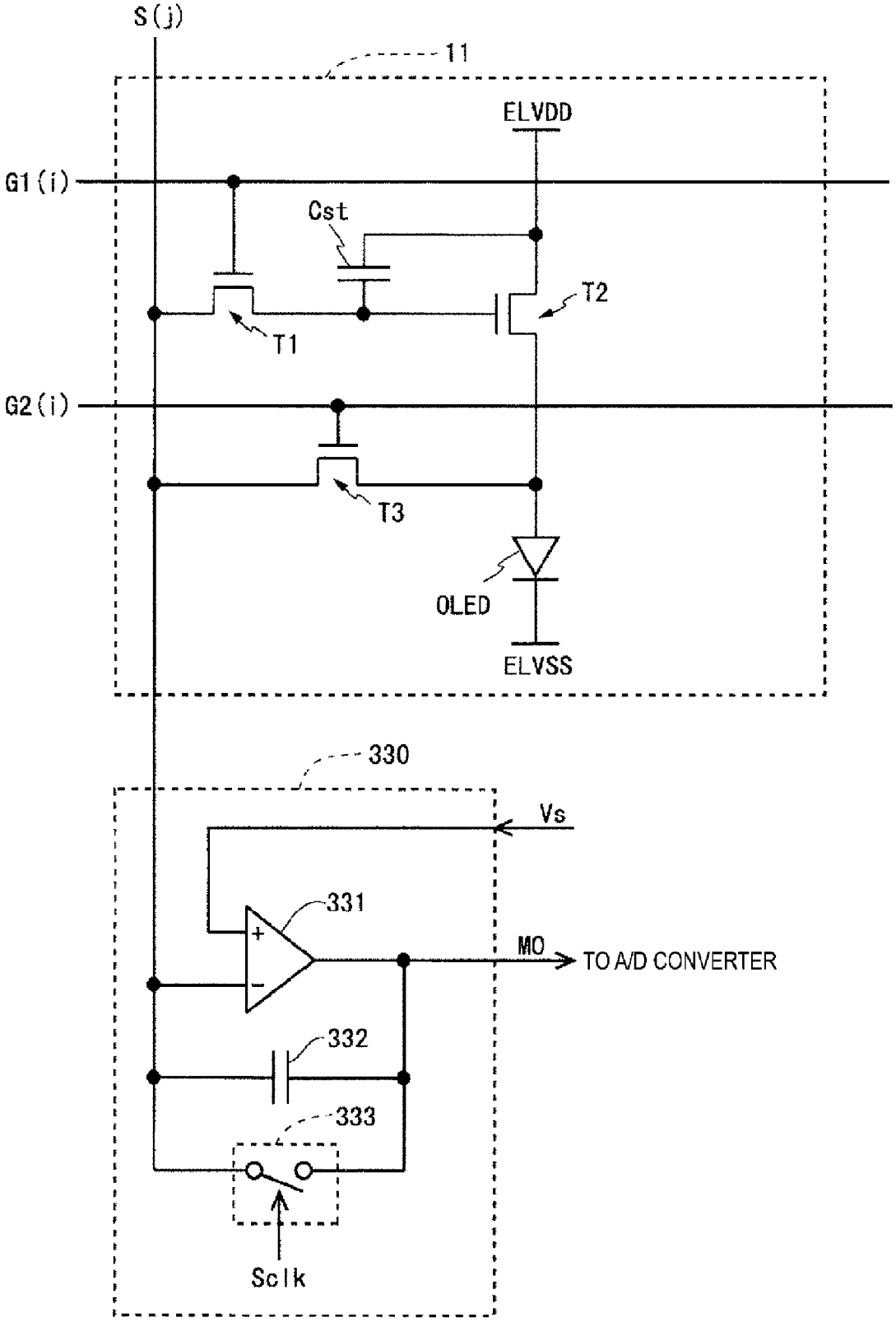
FIG. 2 is a circuit diagram illustrating a configuration of a pixel circuit and an output/current monitoring circuit according to the first embodiment.

FIG. 2 is a circuit diagram illustrating a configuration of a pixel circuit 11 and an output/current monitoring circuit 330. Note that the pixel circuit 11 illustrated in FIG. 2 is a pixel circuit 11 in an i-th row and j-th column. The pixel circuit 11 includes one organic EL element OLED, three transistors T1 to T3, and one capacitor Cst. The transistor T1 functions as an input transistor for selecting a pixel, the transistor T2 functions as a drive transistor that controls supply of a current to the organic EL element OLED, and the transistor T3 functions as a monitoring control transistor that controls whether to detect a TFT characteristic or an OLED characteristic.

The transistor T1 is provided between a data line S(j) and the gate terminal of the transistor T2. With respect to the transistor T1, the gate terminal is connected to a scanning line G1(*i*), and the source terminal is connected to the data line S(j). The transistor T2 is provided in series with the organic EL element OLED. With respect to the transistor T2, the gate terminal is connected to the drain terminal of the transistor T1, the drain terminal is connected to the high-level power supply line ELVDD, and the source terminal is connected to the anode terminal (anode) of the organic EL element OLED. With respect to the transistor T3, the gate terminal is connected to the monitoring control line G2(*i*), the drain terminal is connected to the anode terminal of the organic EL element OLED, and the source terminal is connected to the data line S(j). One end of the capacitor Cst is connected to the gate terminal of the transistor T2, and the other end is connected to the drain terminal of the transistor T2. The cathode terminal (cathode) of the organic EL element OLED is connected to the low-level power supply line ELVSS.

Note that, in the present embodiment, the capacitor Cst is provided between the gate terminal and the drain terminal of the transistor T2. The reason for the configuration is as follows. In the present embodiment, in one frame period, control is performed to vary the potential of the data line S(j) while the transistor T3 is in an on-state. If the capacitor Cst is provided between the gate terminal and the source terminal of the transistor T2, the gate potential of the transistor T2 also varies in accordance with the variation in the potential of the data line S(j). Then, the variation may cause an on/off-state of transistor T2 to be different from a desired state. For this reason, in the present embodiment, the capacitor Cst is provided between the gate terminal and the drain terminal of the transistor T2 as illustrated in FIG. 2 to prevent the gate potential of the transistor T2 from varying in accordance with the variation in the potential of the data line S(j). However, in the case in which the variation in the potential of the data line S(j) little affects the gate potential of the transistor T2, the capacitor Cst may be provided between the gate terminal and the source terminal of the transistor T2.

2.2 Regarding Transistors in Pixel Circuit

According to the present embodiment, all of the transistors T1 to T3 in the pixel circuit 11 are of the n-channel type. In addition, in the present embodiment, oxide TFTs (thin film transistors using an oxide semiconductor in a channel layer) are adopted for the transistor T1 to T3.

An oxide semiconductor layer included in the oxide TFTs will be described below. The oxide semiconductor layer is, for example, an In—Ga—Zn—O based semiconductor layer. The oxide semiconductor layer includes, for example, an In—Ga—Zn—O based semiconductor. The In—Ga—Zn—O based semiconductor contains a ternary oxide with indium (In), gallium (Ga), and zinc (Zn). A ratio of In, Ga, and Zn (composition ratio) is not particularly limited. For example, In:Ga:Zn=2:2:1, In:Ga:Zn=1:1:1, or In:Ga:Zn=1:1:2 may be adopted.

A TFT with an In—Ga—Zn—O based semiconductor layer has a high mobility (mobility 20 times higher than that of an amorphous silicon TFT) and a low leakage current (leakage current less than one-hundredth of that of an amorphous silicon TFT) and thus is preferably used as a drive TFT (the transistor T2) and a switching TFT (the transistor T1) in the pixel circuit. If a TFT with the In—Ga—Zn—O based semiconductor layer is used, power consumption of the display device can be greatly reduced.

The In—Ga—Zn—O based semiconductor may be amorphous or may include a crystalline portion and have crystallinity. A crystalline In—Ga—Zn—O based semiconductor in which a c axis thereof is aligned substantially perpendicular to a layer surface is preferable as a crystalline In—Ga—Zn—O based semiconductor. The crystal structure of such an In—Ga—Zn—O based semiconductor is disclosed in, for example, JP 2012-134475 A.

The oxide semiconductor layer may include another oxide semiconductor in place of the In—Ga—Zn—O based semiconductor. Examples thereof include Zn—O based semiconductors (ZnO), In—Zn—O based semiconductors (IZO (registered trademark)), Zn—Ti—O based semiconductors (ZTO), Cd-Ge-O based semiconductors, Cd—Pb—O based semiconductors, CdO (cadmium oxide), Mg—Zn—O based semiconductors, In—Sn—Zn—O based semiconductors (e.g., $In_2O_3$—$SnO_2$—ZnO), In—Ga—Sn—O based semiconductors, and the like.

2.3 Output/Current Monitoring Circuit

A detailed configuration of the output/current monitoring circuit 330 according to the present embodiment will be described with reference to FIG. 2. The output/current monitoring circuit 330 includes an operational amplifier 331, a capacitor 332, and a switch 333. An inverting input terminal of the operational amplifier 331 is connected to the data line S(j), and a non-inverting input terminal is subject to application of the analog voltage Vs as a data signal DA. The capacitor 332 and the switch 333 are provided between an output terminal of the operational amplifier 331 and the data line S(j). As described above, the output/current monitoring circuit 330 is constituted by an integration circuit. In such a configuration, when the switch 333 is turned on by the control clock signal Sclk, a short-circuit occurs between the output terminal and the inverting input terminal of the operational amplifier 331. As a result, the potential of the output terminal of the operational amplifier 331 and the data line S(j) is equal to the potential of the analog voltage Vs. When a current flowing through the data line S(j) is measured, the switch 333 is turned off by the control clock signal Sclk. As a result, due to the presence of the capacitor 332, the potential of the output terminal of the operational amplifier 331 changes in accordance with the magnitude of the current flowing through the data line S(j). The output from the operational amplifier 331 is sent as the monitoring data MO to the A/D converter in the signal conversion circuit 32.

3. Drive Method

3.1 Overview

Next, a drive method according to the present embodiment will be described. As described above, in the present embodiment, the characteristic detection determination process is performed for one row in each frame as one example. In each frame, an operation for the characteristic detection determination processing (hereinafter, also referred to as a "characteristic detection determination operation") is performed for a monitoring row, and a normal operation is performed for a non-monitoring row. In other words, if a frame in which the characteristic detection determination process is performed for a first row is defined as a (k+1)-th frame, the operation of each row transitions as illustrated in FIG. 3. Furthermore, when TFT characteristics and OLED characteristics are detected as a result of the characteristic detection determination process, the correction data in the correction data storage unit 50 is updated using the detection result. Then, the correction data stored in the correction data storage unit 50 is used to correct the image signal so that deterioration of the circuit elements (the transistor T2, and the organic EL element OLED) is compensated for. Furthermore, in the present embodiment, a value of the low-level power supply voltage ELVSS and a value of the high-level power supply voltage ELVDD are controlled using the detection results of the TFT characteristics and the OLED characteristics. Note that an interval between a time to control a value of the low-level power supply voltage ELVSS and a time to control a value of the high-level power supply voltage ELVDD is not particularly limited.

3.2 Flow of Process

Figure 4:
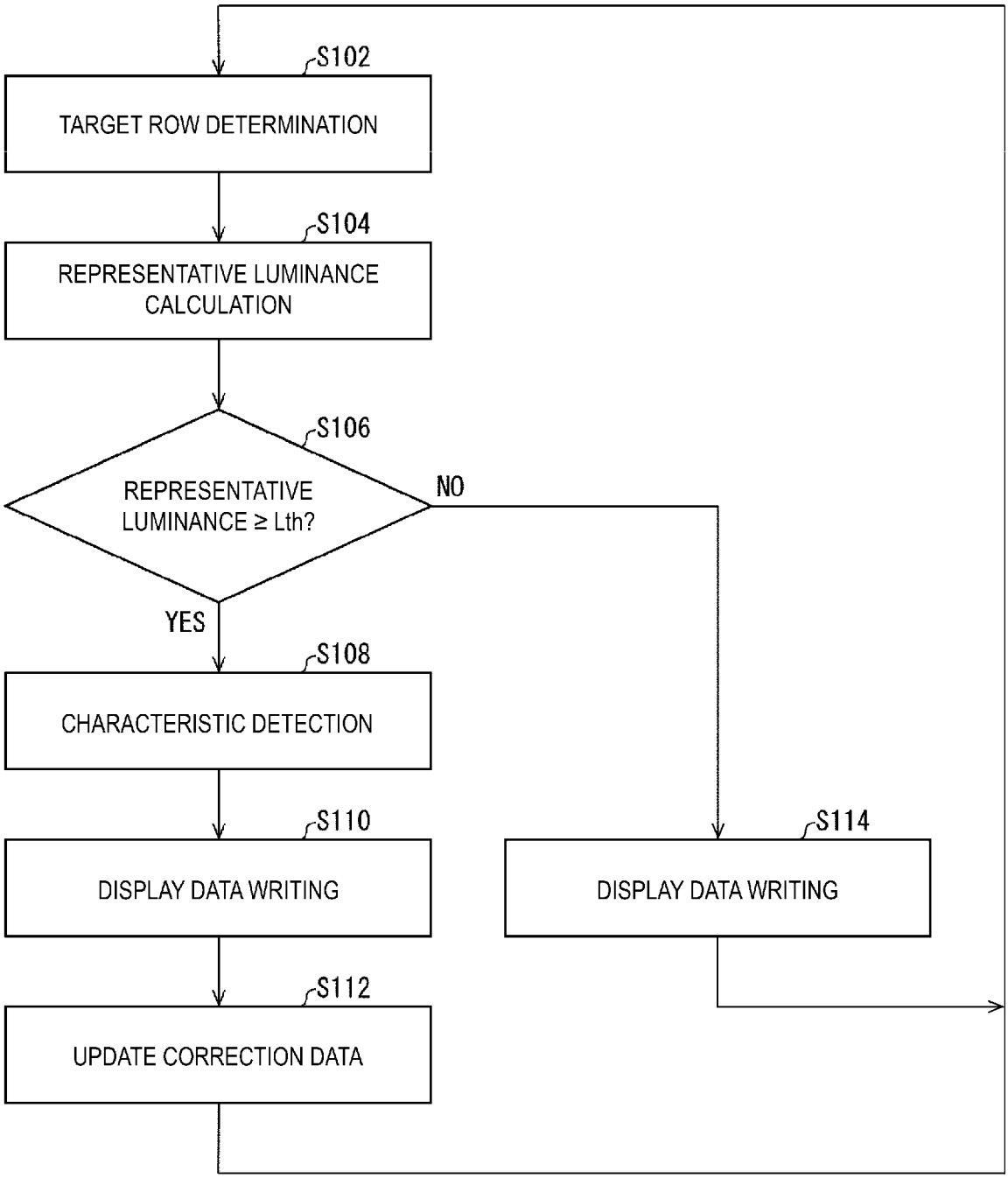
FIG. 4 is a flowchart illustrating a drive process including a characteristic detection determination process according to the first embodiment.

Next, a flow of a drive process according to the present embodiment will described. FIG. 4 is a flowchart illustrating a drive process including the characteristic detection determination process according to the present embodiment.

Step S102

In step S102, the control circuit 20 selects a target row to be subjected to the characteristic detection determination process. As an example, the control circuit 20 sequentially selects one row for one frame as a target row as described above.

Step S104

Subsequently, in step S104, the control circuit 20 calculates a representative luminance, which is a representative value of the luminance of each pixel belonging to the target row based on an image signal sent from the outside (data that is a source of the data signal DA) or a data signal that has not been supplied to each pixel on the target row (in other words, a data signal that is supposed to be input to each pixel on the target row of the target frame from the image signal or a data signal corresponding to the image signal to be displayed in the target frame).

Here, a specific method for calculating the representative luminance is not limited to the present embodiment, and for example, any of the following may be set to the representative luminance.

(1) Average value of the luminance of all pixels included in the target row (2) Maximum value of the luminance of all pixels included in the target row (3) Average value of the luminance of a pixel of a particular color (e.g., any of RGB) included in the target row (4) Maximum value of luminance of a pixel of a particular color (e.g., any of RGB) included in the target row As illustrated in (1) above, in the characteristic detection determination process in the drive method according to the present embodiment, the representative luminance is calculated by combining the average luminances for the respective colors of the pixels of the respective colors belonging to the target row, and the calculated representative luminance is compared to the threshold.

In addition, as illustrated in (3) above, in the characteristic detection determination process in the drive method according to the present embodiment, the representative luminance is calculated as an average luminance of green pixels belonging to the target row, and the calculated representative luminance is compared to the threshold.

In addition, in (3) and (4) described above, the thresholds to be compared to the representative luminance may be set as values different for each color, In this case, in the detection determination process in the drive method according to the present embodiment, the representative luminance may be calculated for each color of the pixels belonging to the target row, and the calculated representative luminance may be compared to the threshold corresponding to the color.

Moreover, for the above-described (1) to (4), a data signal input to a plurality of frames prior to the target frame is further referred to, rather than referring to only the data signal to be input for each pixel on the target row of the target frame. In this case, as a calculation example for (1) described above, (5) a configuration to set, as the representative luminance, an average value of luminance indicated by a data signal to be input to all the pixels included in the target row of the target frame and luminance indicated by a data signal input to all the pixels included in the target row of one or more frames (e.g., one to five frames) prior to the target frame is exemplified, and as a calculation example for (2) described above, (6) a configuration to set, as the representative luminance, the maximum value between the luminance indicated by the data signal to be input to all the pixels included in the target row of the target frame and the luminance indicated by the data signal input to all the pixels included in the target row of the one or more frames (e.g., one to five frames) before the target frame is exemplified. Because even a pixel of a frame viewed a few frames before may remain in the eyes of a viewer as an afterimage, a representative luminance can be suitably set even in the configuration of (5) and (6) described above.

Furthermore, as a calculation example for (3) and (4) described above, a configuration of calculating the representative luminance by focusing on a specific color for (5) and (6) described above may be exemplified.

Step S106

Next, in step S106, the control circuit 20 determines whether the representative luminance calculated in step S104 is greater than or equal to a threshold Lth. When the representative luminance is greater than or equal to the threshold Lth, the control circuit 20 determines that a characteristic detection process should be executed for the target row and proceeds to step S108. Otherwise, the control circuit 20 determines that the characteristic detection process should not be performed on the target row and proceeds to S114.

Step S108

When the representative luminance is greater than or equal to the threshold Lth rn step S106, the control circuit 20 executes the characteristic detection process (also referred to as a characteristic detection operation) on the target row to acquire the monitoring data MO in step S108. Note that step S108 configures the characteristic detection determination process (detection determination step) in conjunction with step S106.

Figure 5:
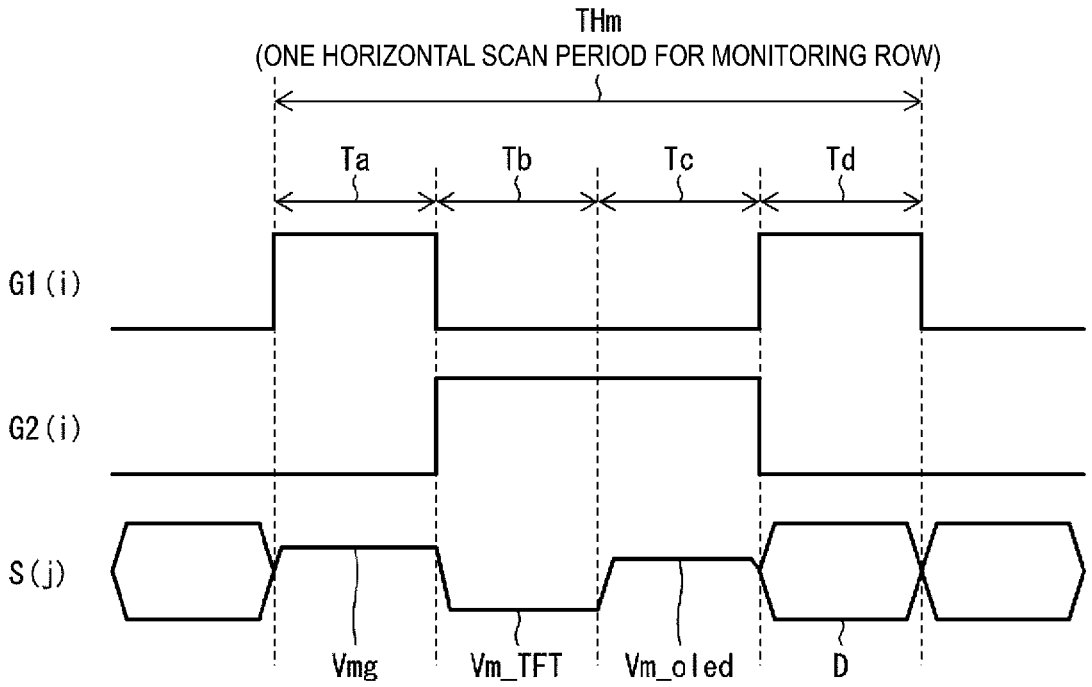
FIG. 5 is a timing chart for explaining a timing of each signal when the characteristic detection process according to the first embodiment is performed.

FIG. 5 is a timing chart for describing a timing of each signal when the characteristic detection process is performed on a target row (i). As illustrated in FIG. 5, one horizontal scan period THm for a monitoring row (target row (i)) includes a period in which preparation for detecting TFT characteristics and OLED characteristics in the monitoring row is performed (hereinafter referred to as a "detection preparation period") Ta, a period in which a current is measured to detect the TFT characteristics (hereinafter, referred to as a "TFT characteristic detection period") Tb, a period in which a current is measured to detect the OLED characteristics (hereinafter, referred to as an "OLED characteristic detection period") Tc, and a period in which the organic LL element OLED is caused to be prepared for emitting light in the monitoring row (hereinafter referred to as a "light emission preparation period") Td.

In the detection preparation period Ta, the scanning line G1 is set to an active state, the monitoring control line G2 is set to a non-active state, and a potential Vmg is applied to the data line S. In the TFT characteristic detection period Tb, the scanning line GI is set to a non-active state, the monitoring control line G2 is set to in an active state, and a potential Vm_TFT is provided to the data line S. In the OLED characteristic detection period Tc, the scanning line G1 is set to a non-active state, the monitoring control line G2 is set to an active, and a potential Vm_oled is applied to the data line S. Note that the potential Vmg, the potential Vm_TFT, and the potential Vm_oled will be described in detail below.

Step S110

Next, in step S110, the source driver 30 writes a data potential D, which is display data, for each pixel included in the target row. This step corresponds to the light emission preparation period Td in FIG. 5. In the light emission preparation period Td, the scanning line G1 is set to an active state, the monitoring control line G2 is set to a non-active state, and the data potential D is applied to the data line S in accordance with the target luminance of the organic EL element OLED included in the monitoring row. Although the data potential D is supposed to be denoted as D (i, j) more specifically, a simple notation D is used in the present specification unless it particularly causes confusion. Note that the data potential D will be described in detail below.

Step S112

Next, in step S112, the control circuit 20 calculates the correction data based on the monitoring data acquired in step S108, and supplies the calculated correction data to the correction data storage unit 50. The correction data storage unit 50 uses the acquired correction data to update the correction data stored in the correction data storage unit 50. The correction data will not be described in detail because it will be described in detail below.

Note that the correction data of the correction data storage unit 50 updated in this step is used to display the subsequent frame next time. More specifically, the correction data based on the results of the characteristic detection for the target row (i) performed in the n-th frame is used to correct the display data supplied to the target row (i) to display frames from the n+1-th frame.

Step S114

On the other hand, when the representative luminance is not greater than or equal to the threshold Lth in S106, the characteristic detection process is skipped, and the source driver 30 writes the data signal DA, which is display data, to each of the pixels included in the target row in step S114.

3.2 Operation of Pixel Circuit 3.2.1 Normal Operation

Figure 6:
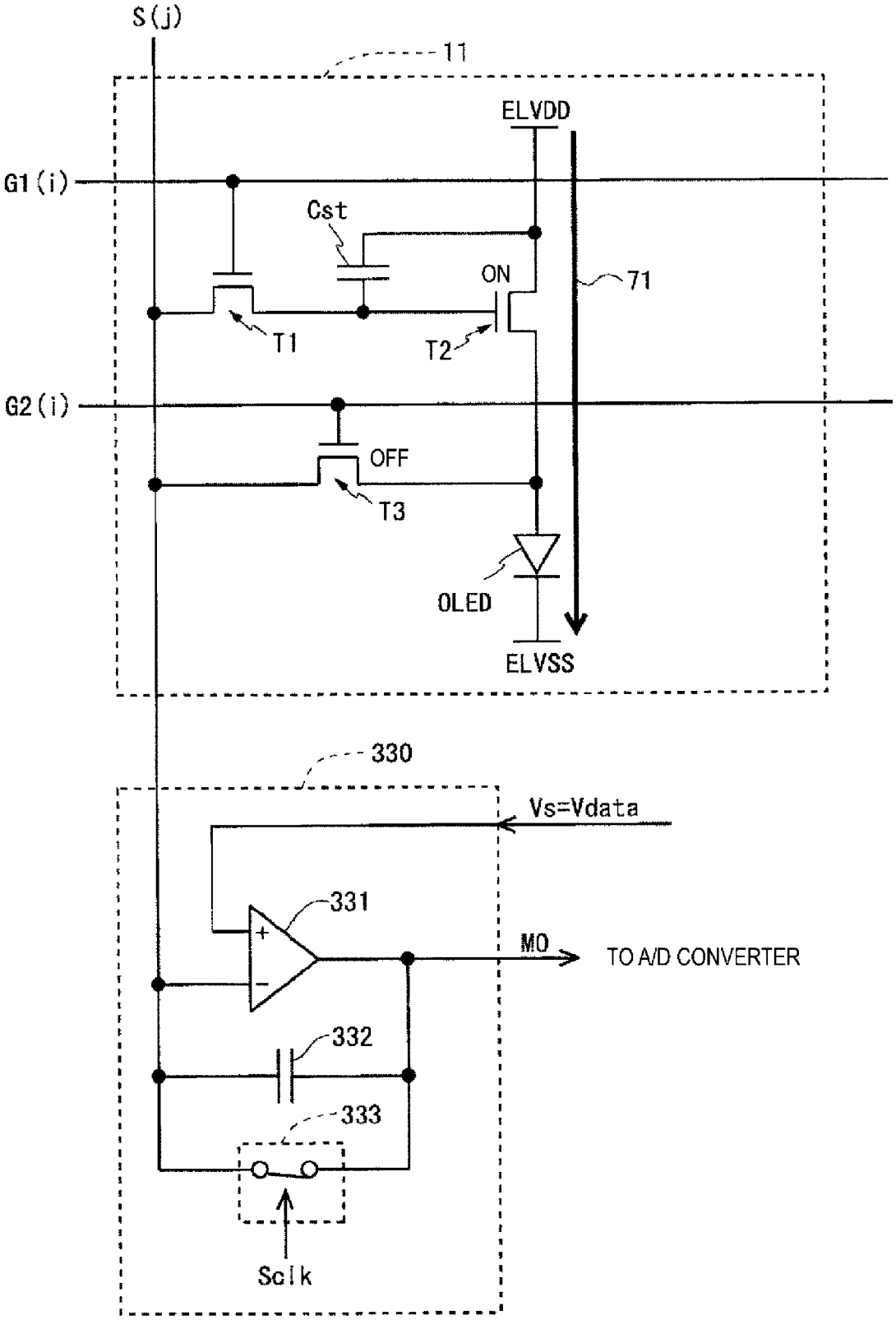
FIG. 6 is a diagram illustrating a configuration of the pixel circuit and the output/current monitoring circuit according to the first embodiment along with a path on which a current flows.

In each frame, normal operation is performed in a non-monitoring row. In the pixel circuit 11 included in the non-monitoring row, after writing based on a data potential Vdata corresponding to the target luminance is performed in a select period, the transistor T1 maintains an off-state. The writing based on the data potential Vdata causes the transistor T2 to be in an on-state. The transistor T3 maintains the off-state. As described above, a drive current is supplied to the organic EL element OLED via the transistor T2 as indicated by the arrow denoted by reference numeral 71 in FIG. 6. As a result, the organic EL element OLED emits light with luminance corresponding to the drive current.

3.2.2 Characteristic Detection Operation

Figure 7:
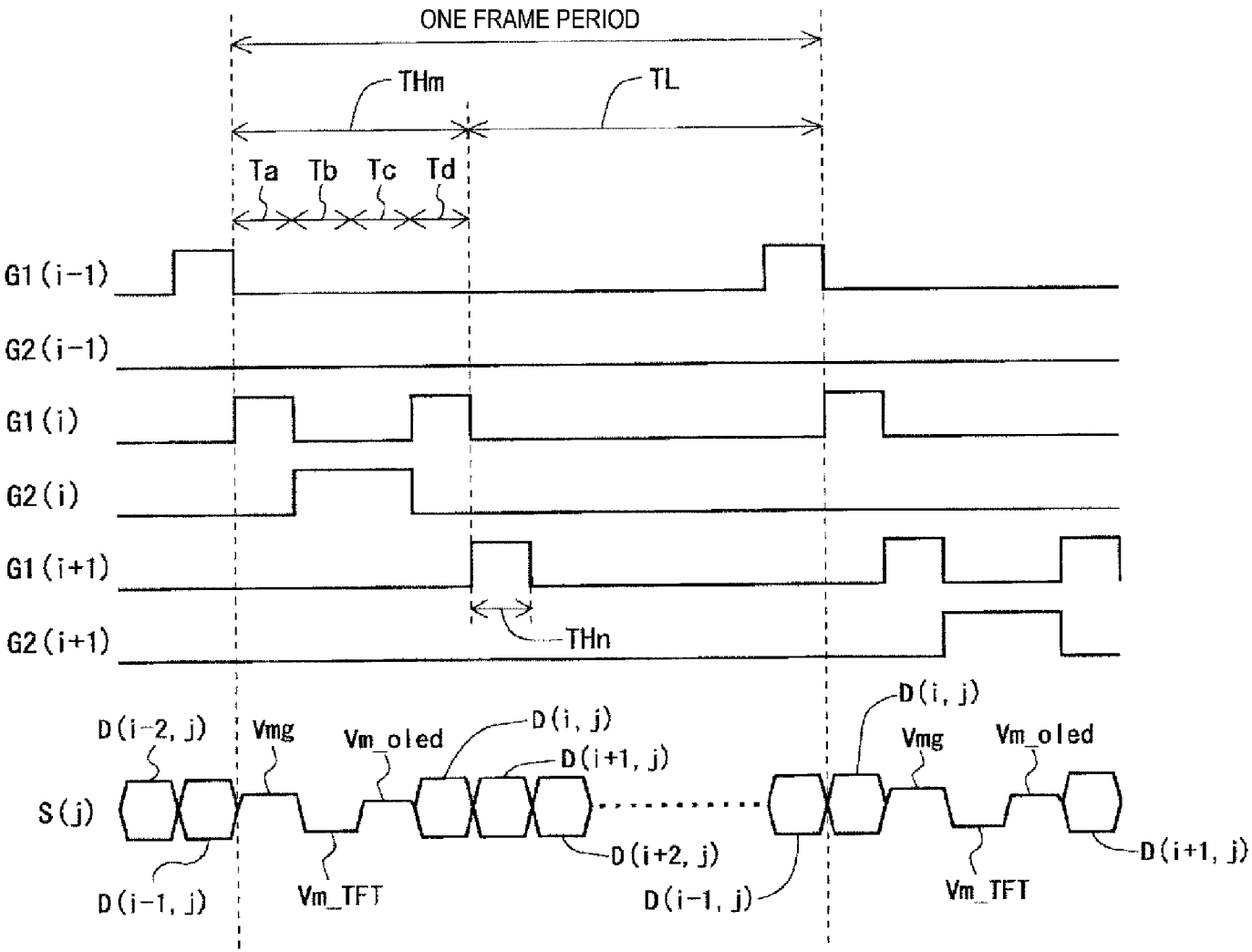
FIG. 7 is a timing chart for describing an operation of the pixel circuit included in a monitoring row.

In each frame, when the characteristic detection determination process is executed and it is determined that the characteristic detection process should be performed for a monitoring row (target row), a characteristic detection operation is performed. FIG. 7 is a timing chart for describing an operation of the pixel circuit 11 included in the monitoring row (which is referred to as the pixel circuit 11 in the i-th row and j-th column) when it is determined that the characteristic detection process should be performed for the monitoring row. Note that, in FIG. 10, "one frame period" is represented with reference to the start timing of the first select period of the i-th row in the frame in which the i-th row is a monitoring row. Here, a period other than the above-described one horizontal scan period THm of one frame period in the monitoring row is referred to as a "light emission period." The light emission period is denoted by reference sign TL. The one horizontal scan period for the monitoring row is denoted by reference sign THm, and one horizontal scan period for the non-monitoring row is denoted by reference sign THn.

First, as can be seen in FIG. 7, the length of one horizontal scan period differs between the monitoring row and the non-monitoring row. Specifically, the length of the one horizontal scan period for the monitoring row is four times the length of the one horizontal scan period for the non-monitoring row. However, the disclosure is not limited to the configuration. For example, the length of the one horizontal scan period for the monitoring row may be approximately 20 times the length of the one horizontal scan period for the non-monitoring row.

For a non-monitoring row, there is a single select period in one frame period, similar to a typical display device. Unlike a typical display device, there are two select periods in one frame period for a monitoring row. The first select period is a first one-fourth period in the one horizontal scan period THm, and the second select period is the final one-fourth in the one horizontal scan period THm.

In addition, in each frame, the monitoring control line G2 corresponding to the non-monitoring row maintains a non-active state as illustrated in FIG. 7. For the monitoring control line G2 corresponding to the monitoring row, the monitoring control line G2 maintains an active state for a period other than the select period in the one horizontal scan period THm (the period in which the scanning line G1 is in the non-active state). In the present embodiment, the gate driver 40 is configured to drive the n scanning lines G1(1) to G1(*n*) and the n monitoring control lines G2(1) to G2(*n*) as described above. Note that in order to generate two pulses in the scanning line G1 during one frame period in the monitoring row, a waveform of an output enable signal sent from the control circuit 20 to the gate driver 40 may be controlled using a known technique.

As described above, in the drive method according to the present embodiment, the characteristic detection step S108 is performed over A (A is an integer greater than or equal to 2) horizontal scan periods, and the supply of the scanning signal to the scanning line in the target row is held within the period of the characteristic detection step S108, and the writing step S110 of writing the data signal in the target row is included after the execution of the characteristic detection step S108.

Figure 8:
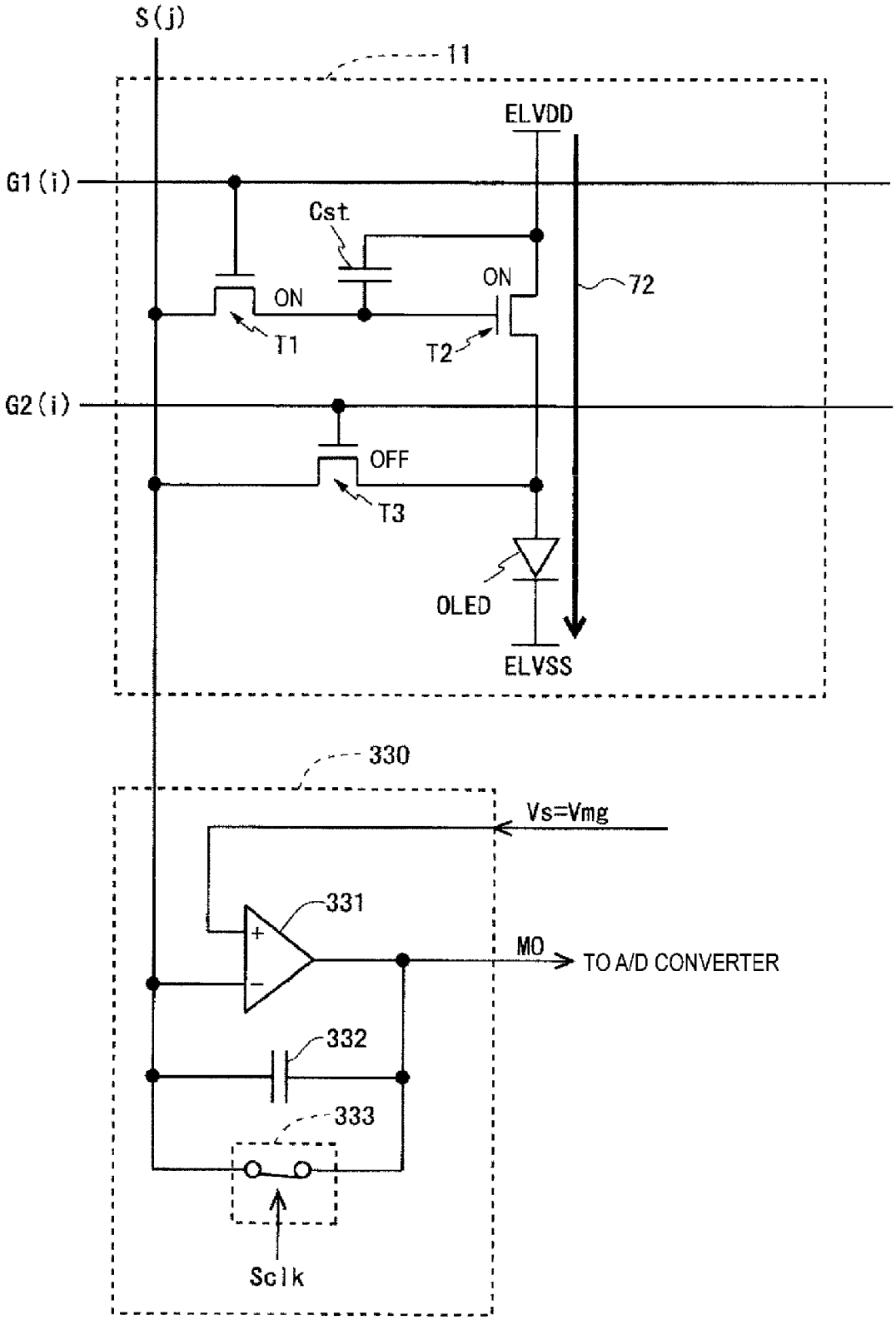
FIG. 8 is a diagram illustrating a configuration of the pixel circuit and the output/current monitoring circuit according to the first embodiment along with a path on which a current flows.

In the detection preparation period Ta, the scanning line G1(*i*) is set to an active state, and the monitoring control tine G2(*i*) maintains a non-active state. Thus, the transistor T1 is set to the on-state and the transistor T3 maintains the off-state. Furthermore, in this period, the potential Vmg is applied to the data tine S(j). The capacitor Cst is charged by writing based on this potential Vmg, and the transistor T2 is set to the on-state. As described above, in the detection preparation period Ta, a drive current is supplied to the organic EL element OLED via the transistor T2, as indicated by the arrow denoted by reference numeral 72 in FIG. 8. As a result, the organic EL element OLED emits light with luminance corresponding to the drive current. However, the organic EL element OLED emits light for a very short period.

In the TFT characteristic detection period Tb, the scanning line G1(*i*) is set to a non-active state, and the monitoring control line G2(*i*) is set to an active state. Thus, the transistor T1 is set to the oft-state and the transistor T3 is set to the on-state. Furthermore, in this period, the potential Vm_TFT is applied to the data line S(j). Note that, in the OLED characteristic detection period Tc, which will be described below, the potential Vm_oled is applied to the data line S(j). In addition, as described above, the writing based on the potential Vmg is performed in the detection preparation period Ta.

Here, if a threshold voltage of the transistor T2 obtained based on an offset value stored in the TFT offset memory 51*a* is set to Vth (T2), values of the potential Vmg, the potential Vm_TFT, and the potential Vm_oled are set such that the following relationships (1) and (2) are satisfied.

$$Vm_TFT+Vth(T2)<Vmg \quad (1)$$

$$Vmg<<Vm_oled+Vth(T2) \quad (2)$$

In addition, if a light emission threshold voltage of the organic EL element OLED obtained based on an offset value stored in th OLED offset memory 51*b* is set to Vth (oled), a value of the potential Vm_TFT is set such that the following relationship (3) is satisfied.

$$Vm_TFT<ELVSS+Vth(oled) \quad (3)$$

Furthermore, if a breakdown voltage of the organic EL element OLED is set to Vbr (oled), a value of the potential Vm_TFT is set, such that, the following relationship (4) is satisfied.

$$Vm_TFT>ELVSS-Vbr(oled) \quad (4)$$

As described above, after the writing based on the potential Vmg satisfying the above relationships (1) and (2) is performed in the detection preparation period Ta, the potential Vm_TFT satisfying the above relationships (1), (3), and (4) is applied to the data line S(j) in the TFT characteristic detection period Tb. With the relationship (1) above, the transistor T2 is set to the on-state in the TFT characteristic detection period Tb. Furthermore, in the TFT characteristic detection period Tb, no current flows through the organic EL element OLED due to the above relationships (3) and (4).

Figure 9:
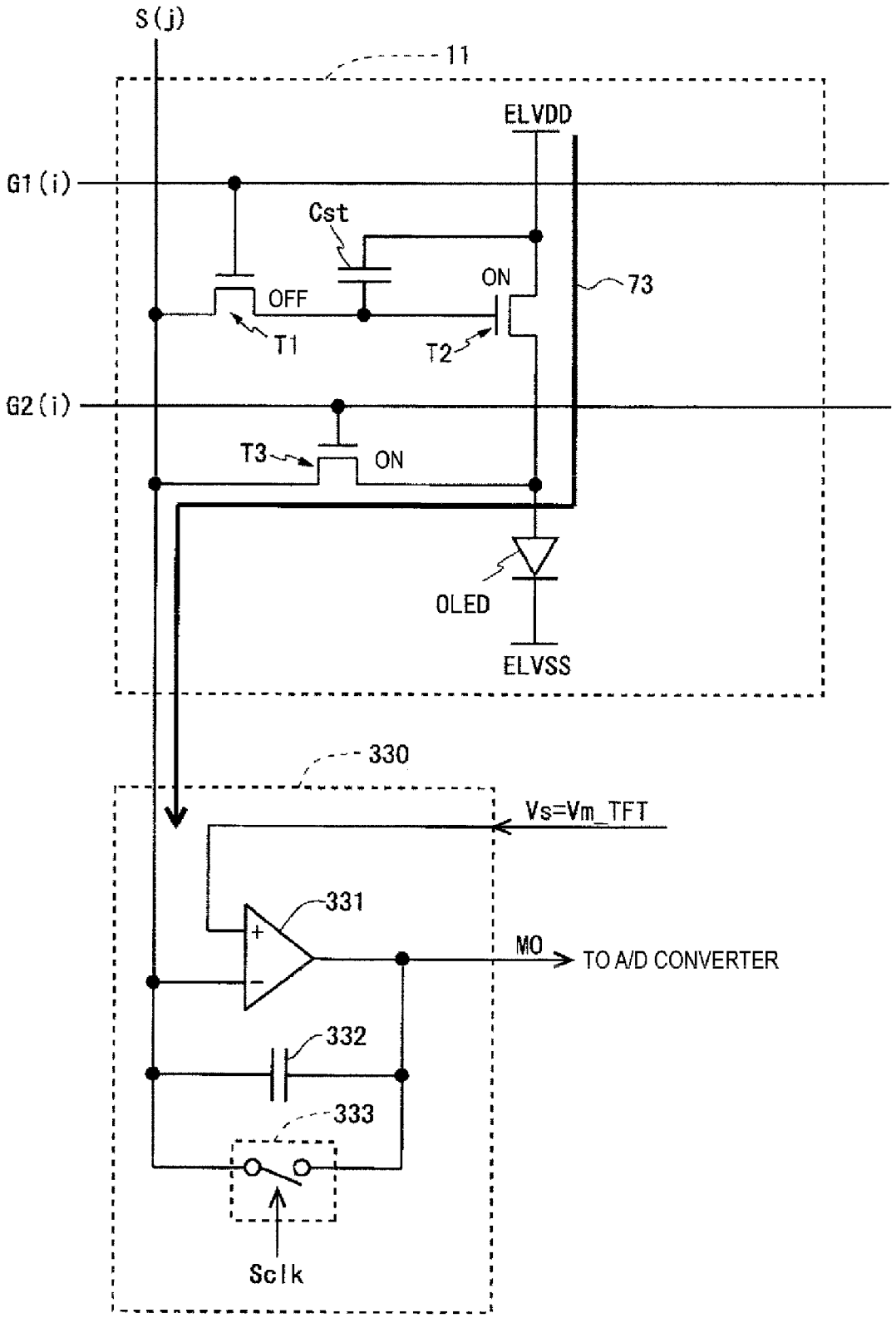
FIG. 9 is a diagram illustrating a configuration of the pixel circuit and the output/current monitoring circuit according to the first embodiment along with a path on which a current flows.

As described above, in the TFT characteristic detection period Tb, the current flowing through the transistor T2 is output to the data line S(j) via the transistor T3, as indicated by the arrow denoted by reference numeral 73 in FIG. 9. As a result, the current (sink current) output to the data line S(j) is measured by the output/current monitoring circuit 330. As described above, the magnitude of the current flowing between the drain terminal and the source terminal of the transistor T2 is measured at a voltage between the gate terminal and the source terminal of the transistor T2 set to a predetermined magnitude (Vmg−Vm_TFT), and TFT characteristics are detected.

In the OLED characteristic detection period Tc, the scanning line G1(*i*) maintains a non-active state, and the monitoring control line G2(*i*) maintains an active state. Thus, during this period, the transistor T1 maintains the off-state and the transistor T3 maintains the on-state. In addition, in this period, the potential Vm_oled is applied to the data line S(j) as described above.

Here, a value of the potential Vm_oled is set so that the above relationship and the following relationship (5) are satisfied.

$$ELVSS+Vth(oled)<Vm_oled \quad (5)$$

In addition, assuming that the breakdown voltage of the transistor T2 is Vbr (T2), a value of the potential Vm_oled is set such that the following relationship (6) is satisfied.

$$Vm_oled<Vmg+Vbr(T2) \quad (6)$$

As described above, in the OLED characteristic detection period Tc, the potential Vm_oled satisfying the above relationships (2), (5), and (6) is applied to the data line S(j). Due to the above relationships (2) and (6), the transistor T2 is set to the off-state in the OLED characteristic detection period Tc. Furthermore, due to the relationship (5) above, a current flows through the organic EL element OLED in the OLED characteristic detection period Tc.

Figure 10:
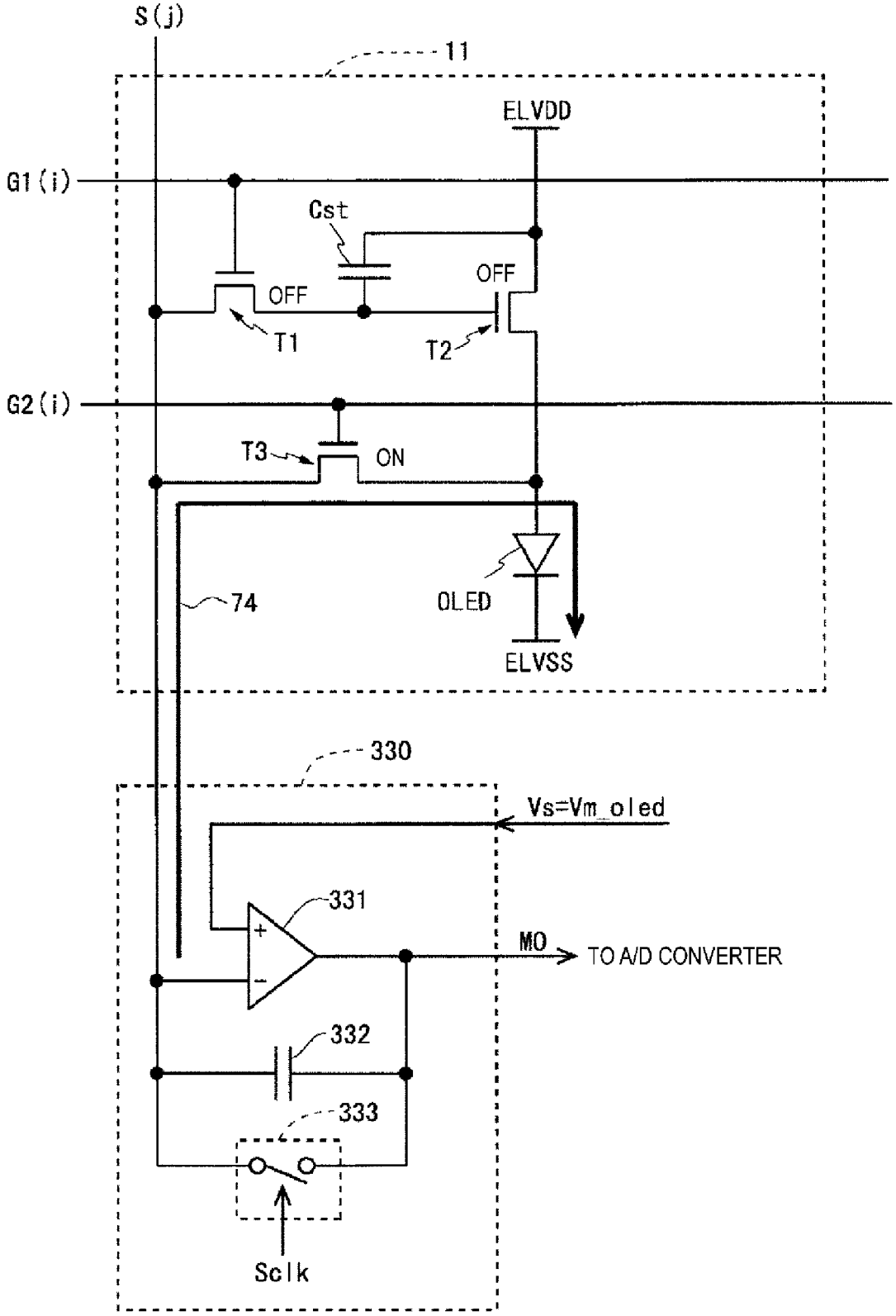
FIG. 10 is a diagram illustrating a configuration of the pixel circuit and the output/current monitoring circuit according to the first embodiment along with a path on which a current flows.

As described above, in the OLED characteristic detection period Tc, a current flows from the data line S(j) to the organic EL element OLED via the transistor T3, as indicated by the arrow denoted by reference numeral 74 in FIG. 10, and the organic EL element OLED emits light. In this state, the current flowing through the data line S(j) is measured by the output/current monitoring circuit 330. As described above, the magnitude of the current flowing through the organic EL element OLED is measured at the voltage between the anode and the cathode of the organic EL element OLED set to a predetermined magnitude (Vm oled-ELVSS), and OLED characteristics are detected.

Note that the value of the potential Vmg, the value of the potential Vm_TFT, and the value of the potential Vm_oled are determined taking the employed measurement range of a current in the output/current monitoring circuit 330, or the like into consideration in addition to the above relationships (1) to (6).

Here, changes in the on/off-states of the switch 333 in the output/current monitoring circuit 330 will be described. When the switch 333 is switched from the off-state to the on-state, the charge accumulated in the capacitor 332 is discharged. After that, when the switch 333 is switched from the on-state to the off-state, charging to the capacitor 332 begins. Then, the output/current monitoring circuit 330 operates as an integration circuit. Note that the switch 333 maintains the off-state for a period of time in which the current flowing through the data line S is to be measured. Specifically, first, after the switch 333 is set to the on-state and the potential Vm_TFT is applied to the data line S in the TFT characteristic detection period Tb, the switch 333 is set to the off-state and the current flowing in the data line S is measured. Next, after the switch 333 is set to the on-state and the potential Vm_oled is applied to the data line S in the OLED characteristic detection period Tc, the switch 333 is set to the off-state and the current flowing in the data line S is measured.

Figure 11:
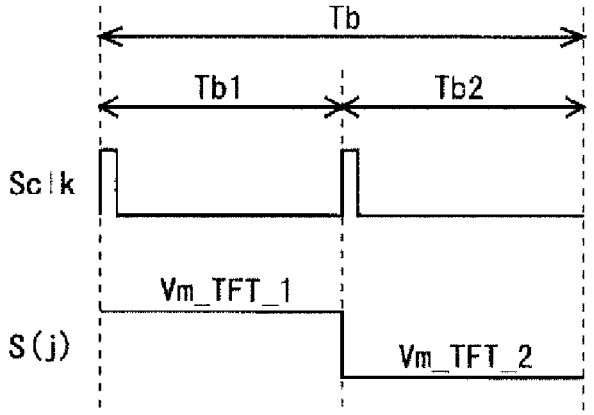
FIG. 11 is a timing chart illustrating a control clock signal Sclk and potentials applied to a data line S(j) in the first embodiment.

However, in the present embodiment, the TFT characteristics are detected based on two types of potentials (Vm_TFT_1 and Vm_TFT_2) in the TFT characteristic detection period Tb, Specifically, by controlling the potentials (Vm_TFT_1 and Vm_TFT_2) applied to the control clock signal Sclk and the data line Sj) for switching the on/off-state of the switch 333 as illustrated in FIG. 11 during the TFT characteristic detection period Tb, the TFT characteristic are detected in a period Tb1 based on the potential Vm_TFT_1, and the TFT characteristic is detected in a period Tb2 based on the potential Vm_TFT_2. Similarly, also in the OLED characteristic detection period Tc, the OLED characteristics are detected based on the two types of potentials.

If a threshold voltage of the transistor T2 is denoted as Vth, a gain of the transistor T2 is denoted as and a gate-source voltage of the transistor 12 is denoted as Vgs, a current I (T2) flowing between the drain terminal and the source terminal of the transistor T2 when the transistor T2 operates in a saturation region is expressed by the following equation (7).

$$I(T2)=(\beta/2)\times(Vgs-Vth)2 \quad (7)$$

Here, the gain β of the transistor T2 is expressed by the following equation (8).

$$\beta=\mu\times(W/L)\times Cox \quad (8)$$

In the above equation (8), μ, W, L, and Cox represent a mobility of the transistor T2, a gate width, a gate length, and a gate insulating film capacitance per unit area, respectively.

With respect to the above equation (8), μ (mobility) varies according to the degree of deterioration of the transistor T2. Thus, β (gain) changes according to the degree of deterioration of the transistor T2. In addition to β, the Vth (threshold voltage) also changes according to the degree of deterioration of the transistor T2 in the equation (7) described above. Because the current is measured based on the two types of potentials in the TFT characteristic detection period Tb in the present embodiment as described above, the threshold voltage and the gain of the transistor T2 at the time point at which the TFT characteristics are detected can be obtained by solving the simultaneous equation based on two equations obtained by substituting the measurement results into the equation (7) above. Note that, because the relationship between β (gain) and μ (mobility) is proportional to β (gain) as can be seen from the equation (8) above, obtaining the gain is equivalent to obtaining the mobility.

Figure 12:
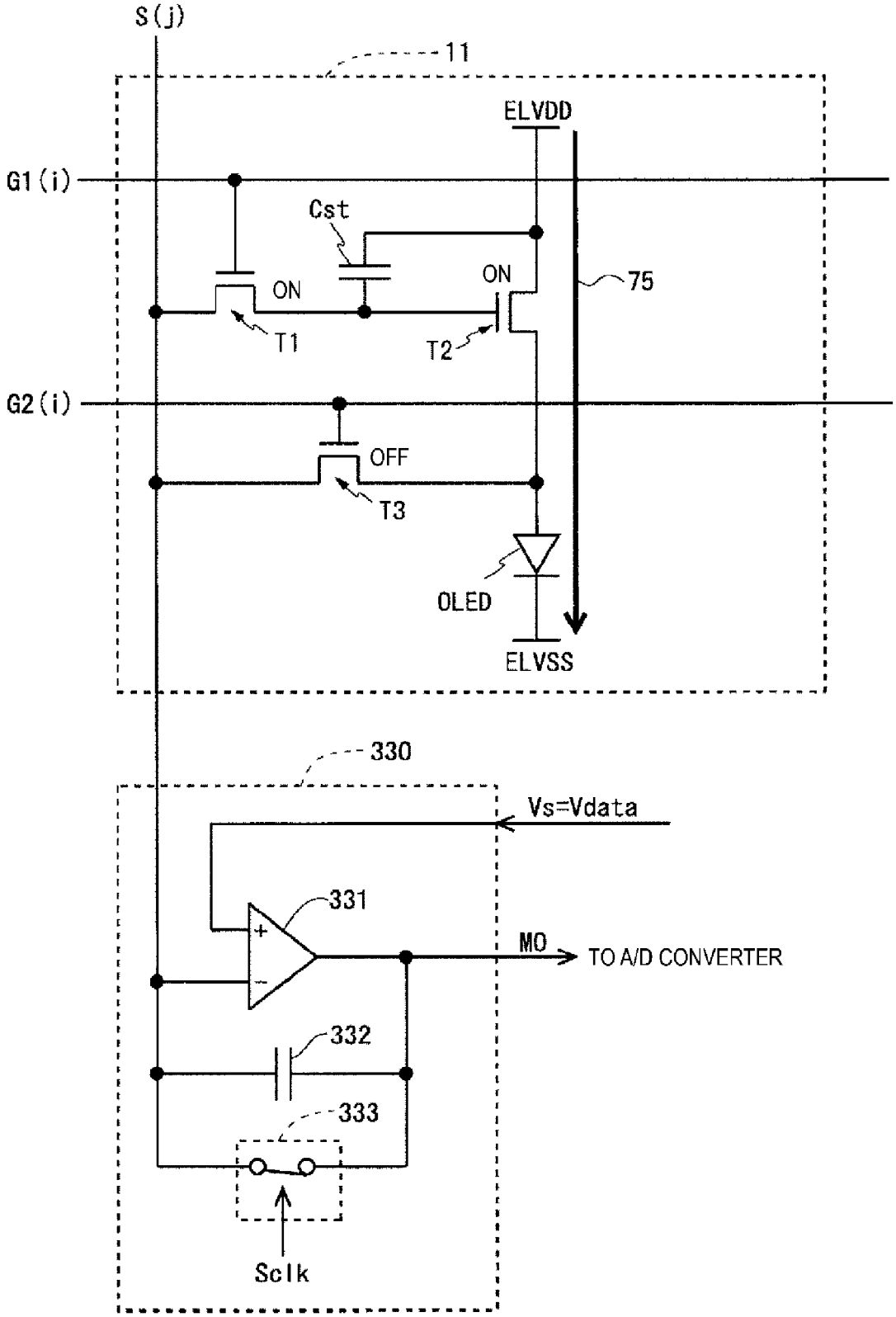
FIG. 12 is a diagram illustrating a configuration of the pixel circuit and the output/current monitoring circuit according to the first embodiment along with a path on which a current flows.

In the light emission preparation period Td, the scanning line G1(*i*) is set to the active state, and the monitoring control line G2(*i*) is set to the non-active state. Thus the transistor T1 is set to the on-state and the transistor T3 is set to the off-state. In addition, in this period, a data potential D (i, j) is applied to the data line S(j) in accordance with target luminance. The capacitor Cst is to be charged due to writing based on the data potential D (i, j) and the transistor T2 is brought into the on-state. As described above, in the light emission preparation period Td, a drive current is supplied to the organic EL element OLED via the transistor T2, as indicated by the arrow denoted by reference numeral 75 in FIG. 12. As a result, the organic EL element OLED emits light with luminance corresponding to the drive current.

Figure 13:
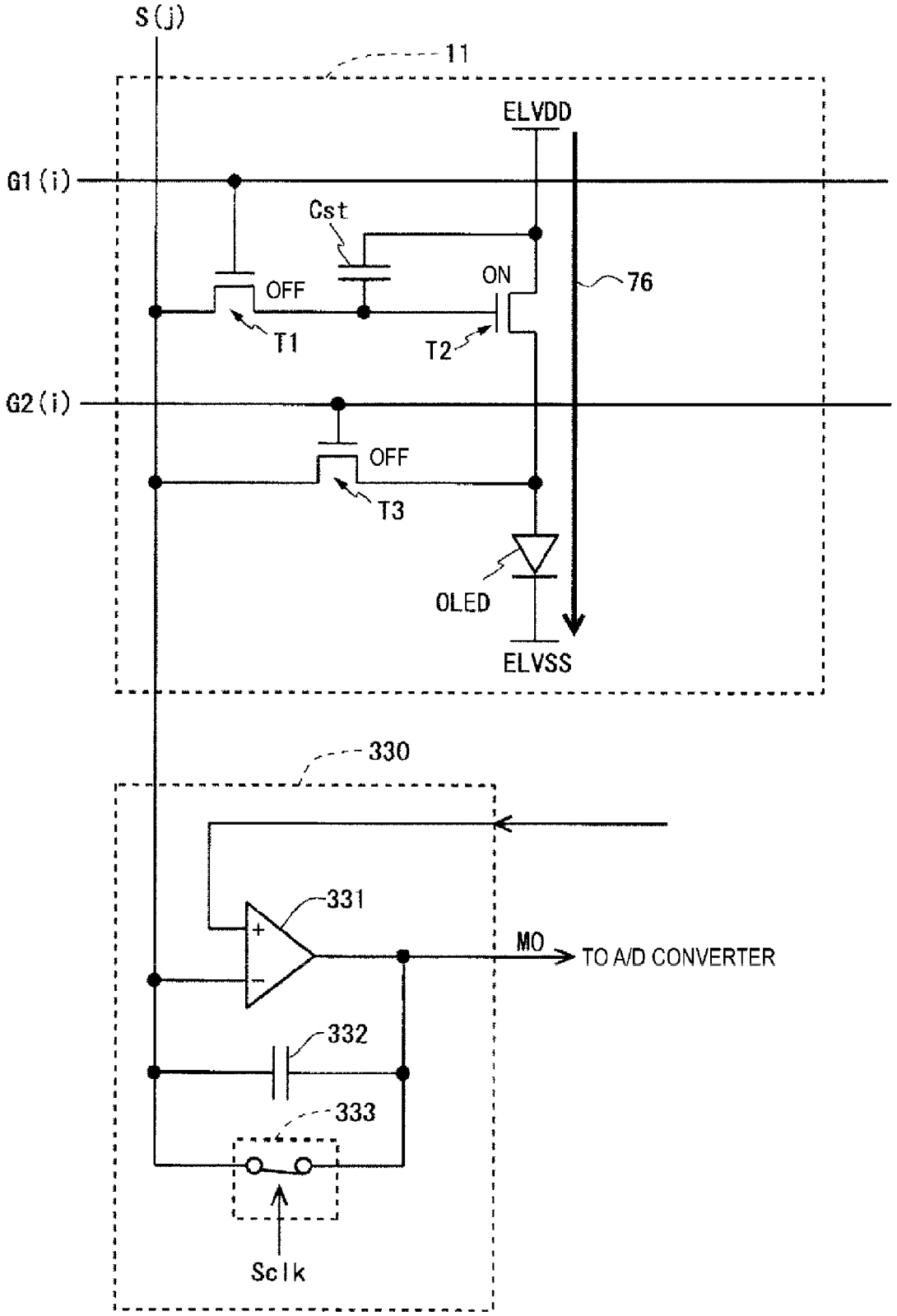
FIG. 13 is a diagram illustrating a configuration of the pixel circuit and the output/current monitoring circuit according to the first embodiment along with a path on which a current flows.

The scanning line G1(*i*) is in the non-active state and the monitoring control line) maintains the non-active state in a light emission period TL. Thus the transistor T1 is set to the off-state and the transistor T3 maintains the off-state. Although the transistor T1 is in the off-state, the transistor T2 maintains the on-state because the capacitor Cst is charged by the writing based on the data potential D (i, j) corresponding to the target luminance during the light emission preparation period Td. Therefore, in the light emission period TL, a drive current is supplied to the organic EL element OLED via the transistor T2, as indicated by the arrow denoted by reference numeral 76 in FIG. 13. As a result, the organic EL element OLED emits light with luminance corresponding to the drive current. In other words, the organic EL element OLED emits light in accordance with the target luminance in the light emission period TL.

In the present embodiment, the characteristic detection determination process is performed for one row per frame as described above, and the TFT characteristics and the OLED characteristics are detected in the target row for which the characteristic detection process is determined to be performed. As a result, the characteristic detection determination process for n rows is performed over a n-frame period.

Note that a technique for detecting the TFT characteristics and the OLED characteristics is not limited to the technique described above. For example, a circuit configuration different from the circuit configuration described above may be employed, or the characteristics of each circuit element may be detected in a different sequence from the above-described sequence.

3.3 Updating of Correction Data and Correction of Image Signal

When the TFT characteristics and the OLED characteristics are detected, the correction data stored in the correction data storage unit 50 is updated based on the detection results. Specifically, because a gain value corresponding to a threshold voltage of the transistor T2 and a mobility of the transistor T2 is obtained in the TFT characteristic detection period Tb as described above, the offset value corresponding to the acquired threshold voltage is stored as a new offset value in the TFT offset memory 51*a*, and the obtained gain value is stored as a new gain value in the TFT gain memory 52*a*. Furthermore, because a threshold voltage of the organic EL element OLED and a deterioration correction coefficient of the organic EL element OLED are acquired in the OLED characteristic detection period Tc, the offset value corresponding to the acquired threshold voltage is stored as a new offset value in the OLED offset memory 51*b*, and the acquired deterioration correction coefficient is stored as a new deterioration correction coefficient in the OLED gain memory 52*b*. Note that, because the TFT characteristics and the OLED characteristics for one row are detected for each frame in the present embodiment, for a one-frame period, m offset values in the TFT offset memory 51*a*, m gain values in the TFT gain memory 52*a*, m offset values in the OLED offset memory 51*b*, and m deterioration correction coefficients in the OLED gain memory 52*b* are updated.

The control circuit 20 corrects the image signal using the correction data stored in the correction data storage unit 50 to compensate for the deterioration of the circuit elements. Note that, in the present embodiment, a value of the low-level power supply voltage ELVSS may be set to a value lower than the value at the initial time point in accordance with the magnitude of a threshold shift (change in the threshold voltage from the initial time point) of the transistor T2 (drive transistor) and the organic EL element OLED. Here, the difference between the value of the low-level power supply voltage ELVSS at the initial time point and the value of the low-level power supply voltage ELVSS at the time point at which the image signal is corrected is expressed by ΔV.

If it is assumed that the voltage after gamma correction of the image signal is denoted by Vc, the gain value stored in the TFT gain memory 52*a* is denoted by B1, the deterioration correction coefficient stored in the OLED gain memory 52*b* is denoted by B2, the offset value stored in the TFT offset memory 51*a* is denoted by Vt1, and the offset value stored in the OLED offset memory 51*b* is denoted by Vt2, the corrected voltage Vdata is obtained using the following equation (9).

$$\text{Vdata}=\text{Vc}\cdot B1\cdot B2+\text{Vt1}+\text{Vt2}-\Delta V \tag{9}$$

A digital signal representing the voltage Vdata determined by the above equation (9) is sent as the data signal DA from the control circuit 20 to the source driver 30. Note that the corrected voltage Vdata may be obtained using the following equation (10) to compensate for attenuation of the data potential due to parasitic capacitance in the pixel circuit 11.

$$\text{Vdata}=Z(\text{Vc}\cdot B1\cdot B2+\text{Vt1}-\text{Vt2}-\Delta V) \tag{10}$$

Here, Z is a coefficient to compensate for attenuation of the data potential.

Second Embodiment

A second embodiment of the disclosure will be described below.

An overview of a drive method and a display device according to the present embodiment is the same as that described in the first embodiment, and thus repetitive description will be omitted and differences from the first embodiment will be mainly described below. In addition, with respect to each member and step, the same reference signs will be given to the same members and steps as those described above, and descriptions thereof will be omitted as appropriate.

Characteristic Detection Step

In the first embodiment, the example in which, in a case in which the control circuit 20 selects the target row one time and then determines that the characteristic detection process should be performed, two different potentials for characteristic detection are supplied to the same data line S in one horizontal scan period of the target row to detect the TFT characteristics for each of the potentials, and two additional different potentials for characteristic detection are supplied to the same data line S to detect the OLED characteristics for each of the potentials has been described as described with reference to FIG. 5 and FIG. 11. However, this is not intended to limit the embodiments described in the present specification.

In the present embodiment, a configuration in which, in a case in which the control circuit 20 determines the characteristic detection process should be performed in the characteristic detection determination process after selecting the target row one time, one potential for the characteristic detection is supplied to the data line S in one horizontal scan period of the target row to detect either the TFT characteristics or the OLED characteristics will be described.

Figure 14:
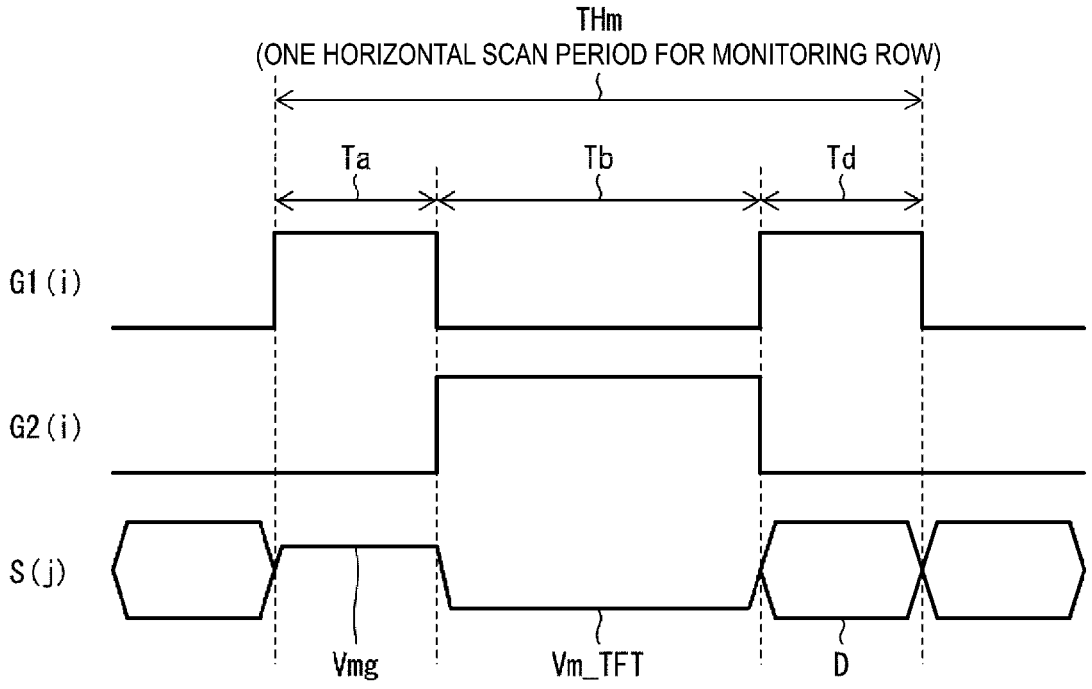
FIG. 14 is a timing chart for explaining a timing of each signal when a characteristic detection process according to a second embodiment is performed.
Figure 15:
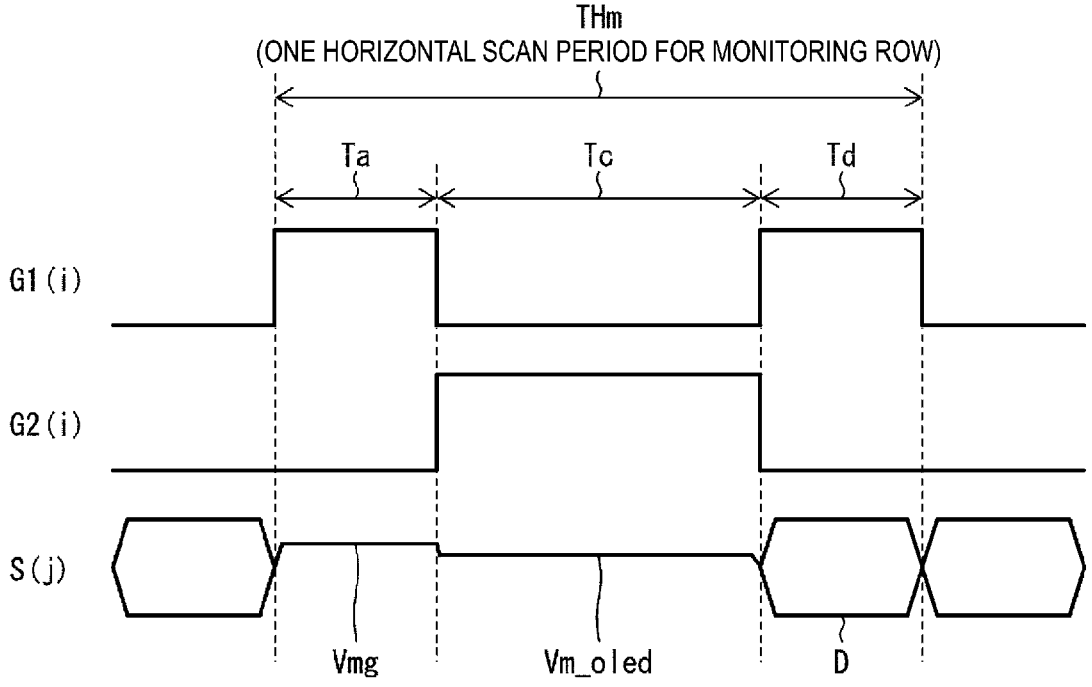
FIG. 15 is a timing chart for explaining a timing of each signal when the characteristic detection process according to the second embodiment is performed.

FIGS. 14 and 15 are timing charts to describe timings of signals when the characteristic detection process according to the present embodiment is performed for a target row (i).

In the example illustrated in FIG. 14, only TFT characteristic detection based on one potential is used as the characteristic detection process. As illustrated in FIG. 14, one horizontal scan period THm for a monitoring row (target row (i)) is configured by a detection preparation period Ta, a TFT characteristic detection period Tb, and a light emission preparation period Td.

In the example illustrated in FIG. 15, only OLED characteristic detection based on one potential is used as the characteristic detection process. As illustrated in FIG. 15, one horizontal scan period THm for a monitoring row (target row (i)) is configured by a detection preparation period Ta, an OLED characteristic detection period Tc, and a light emission preparation period Td.

Characteristic Detection Determination Process

The characteristic detection determination process according to the present embodiment may be performed in the same manner as in the first embodiment or may be performed as follows. In other words, in the characteristic detection determination process according to the present embodiment, the OLED characteristic detection step of detecting monitoring data indicative of the characteristics of OLEDs is to be skipped, and the TFT characteristic detection step of detecting monitoring data indicative of the characteristics of TFTs is not to be skipped.

In the TFT characteristic detection, the OLEDs do not emit light, as described in the first embodiment with reference to FIG. 9. Thus, the TFT characteristic detection does not make users feel uncomfortable. On the other hand, in the OLED characteristic detection, the OLEDs emit light and thus may make users feel uncomfortable.

According to the configuration described above, the OLED characteristic detection is to be skipped, and the TFT characteristic detection is not to be skipped, and thus it is possible to reduce the sense of discomfort of users resulting from light emission in an inspection.

First Example of Target Row Setting Process

Figure 16:
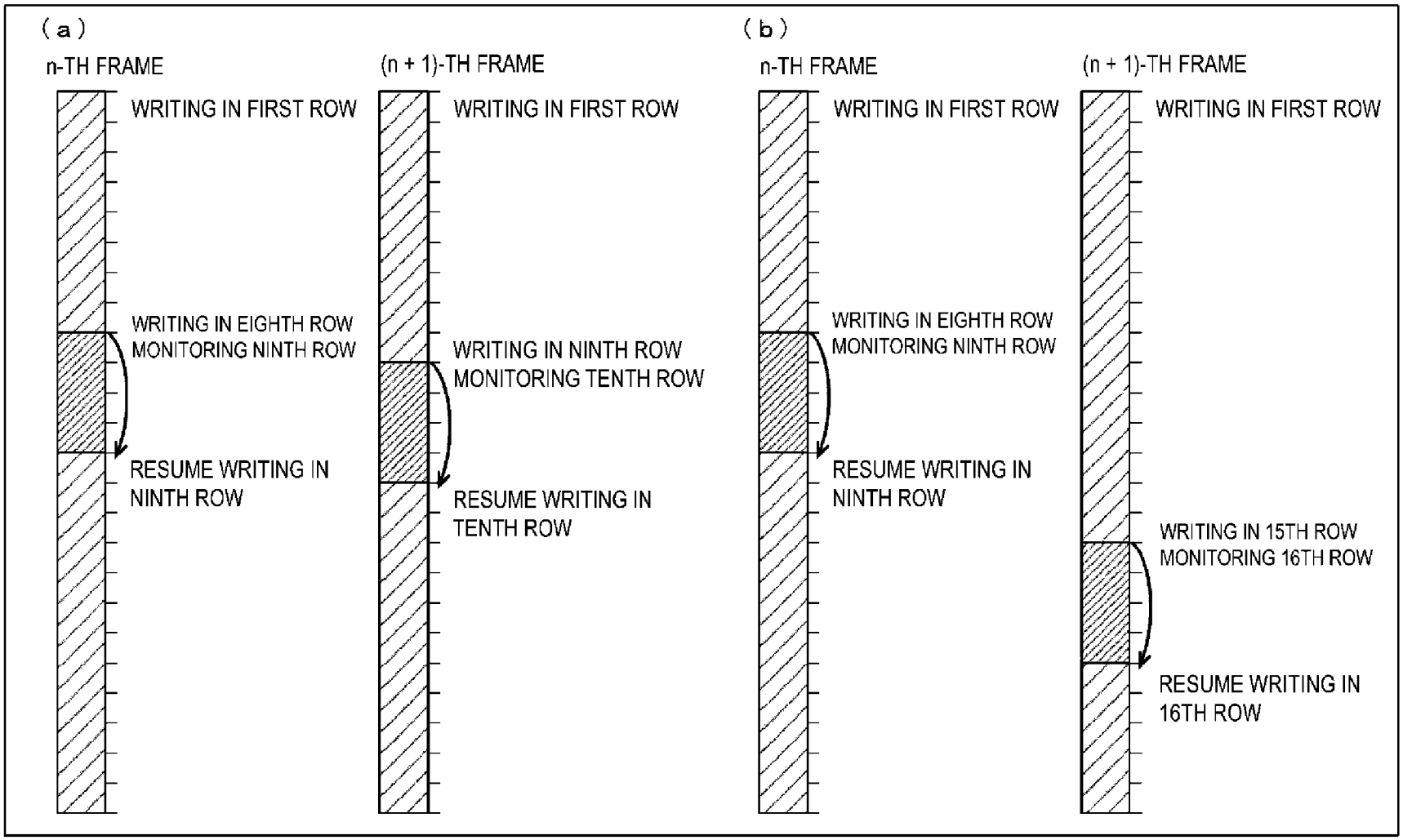
FIG. 16 is a schematic diagram illustrating an example of a target row setting process of a control circuit according to the second embodiment.

FIG. 16 is a schematic diagram illustrating an example of a target row setting process of the control circuit 20 according to the present embodiment. As an example, in an n-th frame, the control circuit 20 according to the present embodiment writes a data potential into the pixels of the eighth row performs the characteristic detection determination process ("monitoring" in the drawing) according to the present embodiment for the ninth row as a target row, and resumes writing on the ninth row as illustrated in (a) of FIG. 16. Then, in a n+1-th frame, a data potential is written into the pixels on the ninth row, monitoring is performed for the tenth row as a target row, and the writing is resumed on the tenth row.

In this manner, the control circuit 20 according to the present embodiment can be configured to sequentially select target rows. This is similar to the content described in step S102 of FIG. 4.

In addition, as another example, in the n-th frame, the control circuit 20 according to the present embodiment writes a data potential into the pixels of the eighth row, performs the characteristic detection determination process according to the present embodiment for the ninth row as a target row, and resumes writing on the ninth row as illustrated in (b) of FIG. 16. Then, in the n+1-th frame, a data potential is written into the pixels on the 15th row, monitoring is performed for the 16th row as a target row, and the writing is resumed on the 16th row.

In this manner, the control circuit 20 according o the present embodiment may be configured to randomly select target rows in step S102 of FIG. 4.

Figure 17:
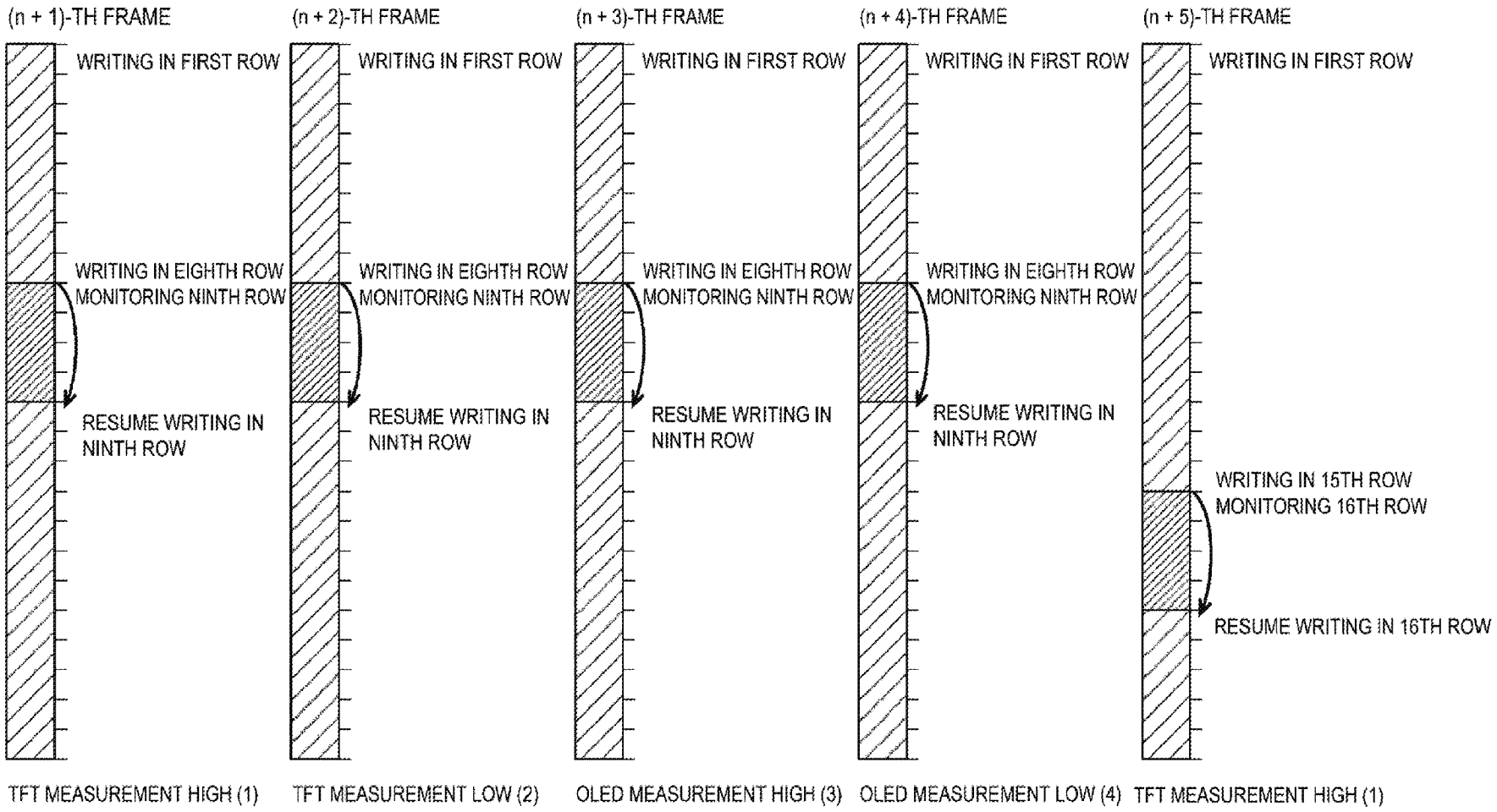
FIG. 17 is a schematic diagram illustrating another example of the target row setting process of the control circuit according to the second embodiment.

FIG. 17 is a schematic diagram illustrating another example of the target row setting process of the control circuit 20 according to the present embodiment.

In the present embodiment, the detection determination processing step may be performed on the same row as the target row over a predetermined number of multiple frames while a potential supplied to the data lines S is changed. For example, the control circuit 20 according to the present embodiment may perform the detection determination processing step and change a potential supplied to the data line S while setting the same row (the ninth row in the example of FIG. 17) as a target row from the n+1-th frame to the n+4-th frame to perform first TFT characteristic detection ("TFT measurement HIGH (1)" in the drawing), second TFT characteristic detection ("TFT measurement LOW (2)" in the drawing), first OLED characteristic detection ("OLED measurement HIGH (3)" in the drawing), and second OLED characteristic detection ("OLED measurement LOW (4)" in the drawing) as illustrated in FIG. 17.

Further, the control circuit 20 according to the present embodiment may be configured to set a target row at random, set the 16-th row as a target row in an n+5-th frame as illustrated in FIG. 17, for example, following the four characteristic detection processes described above, and perform detection after the first TFT characteristic detection.

Further, the control circuit 20 according to the present embodiment may be configured to sequentially set a target row, set the tenth row as a target row, which is not illustrated, in the n+5-th frame following the four characteristic detection processes described above, and perform detection after the first TFT characteristic detection.

Second Example of Target Row Setting Process

The control circuit 20 according to the present embodiment may perform the target row determination step and the characteristic detection determination process as follows.

In other words, the control circuit 20 may be configured to perform the characteristic detection process or the characteristic detection determination process by supplying different potentials to the data lines S for each of consecutive sets of frame series by sequentially performing the first to fourth processes as described below.

First Process

The control circuit 20 performs the characteristic detection determination process by setting one target row per frame while shifting by one row for consecutive frames corresponding to the number of rows included in the display device 1 and supplying a first potential to the data tines S in the target row.

Second Process

After the first process, the control circuit 20 performs the characteristic detection determination process by setting one target row per frame while shifting by one row for consecutive frames corresponding to the number of rows and supplying a second potential to the data lines S in the target row.

Third Process

After the second process, the control circuit 20 performs the characteristic detection determination process by setting one target row per frame while shifting by one row for consecutive frames corresponding to the number of rows and supplying a third potential to the data lines S in the target row.

Fourth Process

After the third process, the control circuit 20 performs the characteristic detection determination process by setting one target row per frame while shifting by one row for consecutive frames corresponding to the number of rows and supplying a fourth potential to the data lines S in the target row.

Here, the configuration in which, more specifically, the OLED characteristics are detected based on the first and second potentials as the first and second processes, and more specifically, the TFT characteristics are detected based on the third and fourth potentials as the third and fourth processes is exemplified.

Note that, if there is a row for which the characteristic detection step has been skipped in the first to fourth processes as in the present example, the characteristic detection determination process may be performed again for the skipped row after the first to fourth processes are completed. With the above-described configuration, the characteristic detection process can be performed intensively on the row for which the characteristic detection step has been skipped.

Third Example of Target Row Setting Process

Figure 18:
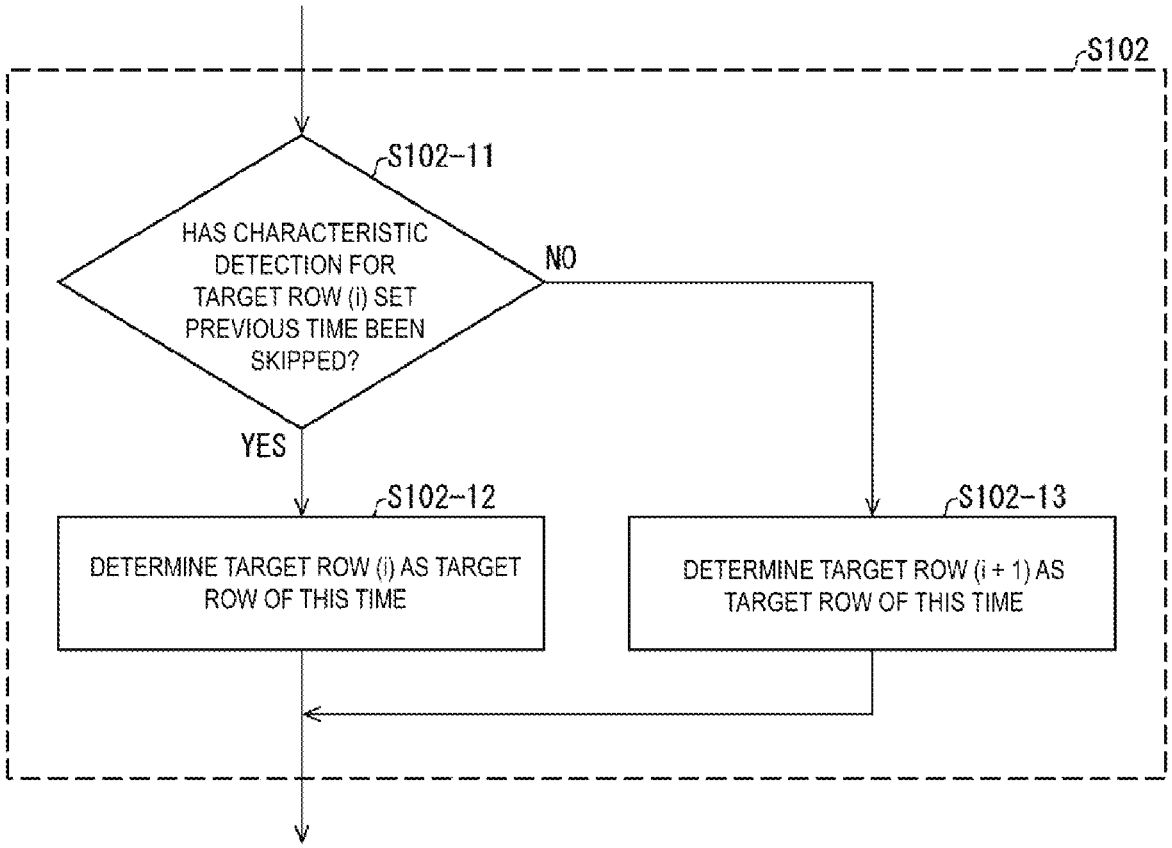
FIG. 18 is a flowchart illustrating an example of the target row setting process of the control circuit according to the second embodiment.

FIG. 18 is a flowchart illustrating another example of the target row setting process of the control circuit 20 according to the present embodiment. The target row determination step S102 illustrated in FIG. 4 in the first embodiment includes the steps illustrated in FIG. 18 in the present example.

Step S102-11

In this step, the control circuit 20 determines whether the characteristic detection step for the target row (i) set in the previous time has been skipped. If the characteristic detection step for the target row (i) set in the previous time has been skipped, the process proceeds to step S102-12; otherwise, the process proceeds to step S102-13.

Step S102-12

If it is determined in step S102-11 that the characteristic detection step for the previously set target row (i) has been skipped, the same target row (i) as that of the previous time is determined to be a target row of this time in this step.

Thus, in the present example, in the detection determination process, if the characteristic detection step for the target row has been skipped, the target row is set as a target row again in the next target row determination step.

Step S102-13

On the other hand, if it is determined in step S102-11 that the characteristic detection step for the target row (i) set in the previous time has been skipped, a different target row (e.g., target row (i+1)) from that of the previous time is determined to be a target row of this time in this step. Note that a target row may be set in this step by randomly setting any row except the target row of the previous time as a target row.

Fourth Example of Target Row Setting Process

Figure 19:
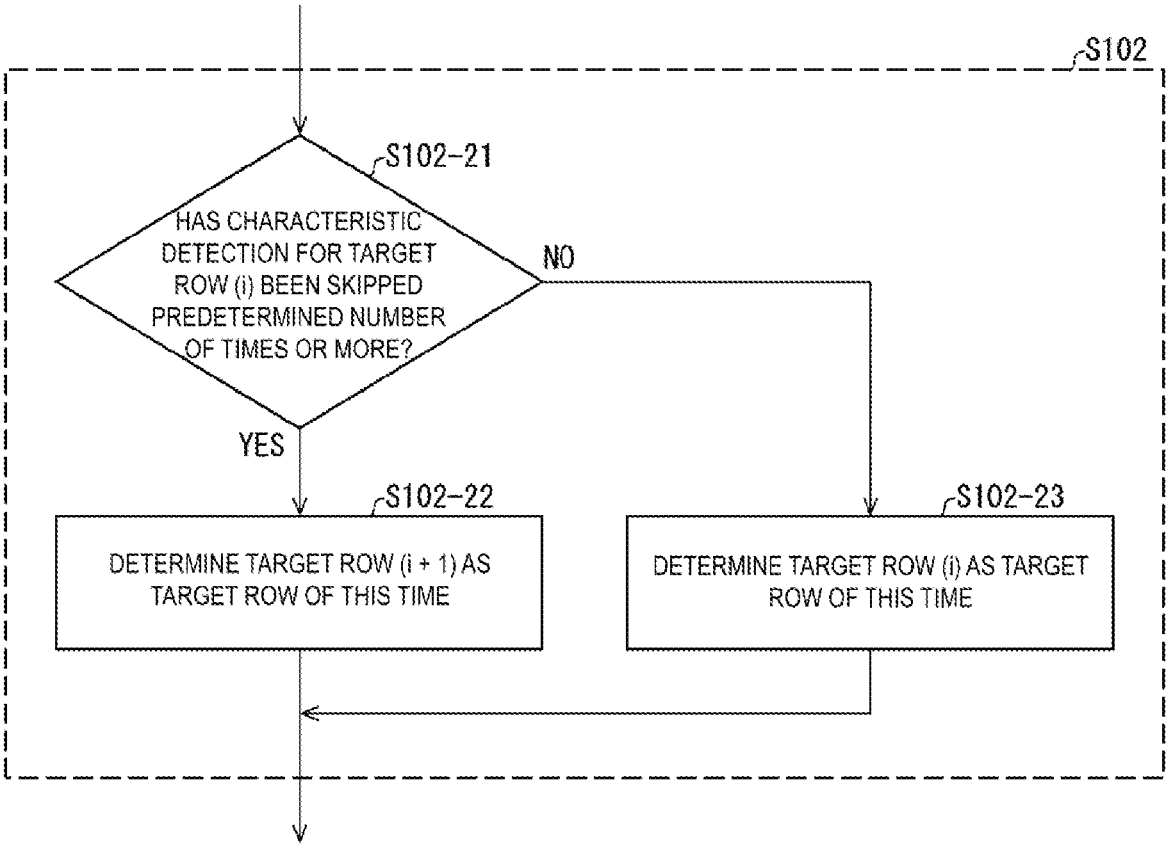
FIG. 19 is a flowchart illustrating another example of the target ow setting process of the control circuit according to the second embodiment.

FIG. 19 is a schematic diagram illustrating another example of the target row setting process of the control circuit 20 according to the present embodiment. The target row determination step S102 illustrated in FIG. 4 in the first embodiment includes the steps illustrated in FIG. 19 in the present example.

Step S102-21

In this step, the control circuit 20 determines whether the characteristic detection step for the target row (i) set in the previous time has been skipped a predetermined number of times or more. If the characteristic detection step has been skipped the predetermined number of times or more, the process proceeds to step S102-22; otherwise, the process proceeds to step S102-23.

Note that, although a specific example of the predetermined number of times does not limit the present embodiment, for example, approximately five times to ten times can be adopted.

Step S102-22

If it is determined in step S102-21 that the characteristic detection step for the target row (i) set in the previous time has been skipped the predetermined number of times or more, the control circuit 20 determined a target row (i+1) as a target row of this time.

Thus, in the present example, in the detection determination step, when the characteristic detection step for the target row has been skipped the predetermined number of times, the next row of the target row is set as a target row in the next target row determination step.

According to the above-described configuration, when the characteristic detection step for a certain target row has been skipped a predetermined number of times, the next row is set as a target row, and thus, a situation in which the characteristic detection step is stopped in a particular row and the characteristic detection is not performed for other rows can be avoided.

Thus, the present example may be configured such that, when the characteristic detection step for the target row has been skipped the predetermined number of times in the detection determination step, a different row from the target row may be randomly set as a target row in the next target row determination step.

Image Signal Correction and Conversion Process

In the present embodiment, the source driver 30 converts the corrected voltage Vdata represented by the equation (9) or (10) with reference to a lookup table (LUT), and then supplies the voltage Vdata to the source line S.

Figure 20:
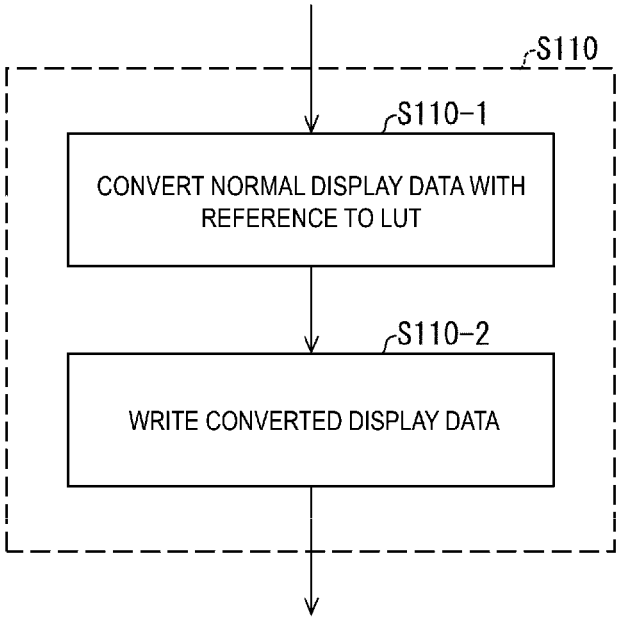
FIG. 20 is a flowchart illustrating a configuration of a display data writing step included in a drive method according to the second embodiment.

FIG. 20 is a flowchart illustrating a configuration of display data writing step S110 included in the drive method according to the present embodiment. Step S110 illustrated in FIG. 20 is used in this embodiment instead of step S110 illustrated in FIG. 4.

As illustrated in FIG. 20, the display data writing step S110 according to the present embodiment includes the following steps.

Step S110-1

The control circuit 20 according to the present embodiment converts normal display data with reference to an LUT. Here, "normal display data" refers to corrected display data in the case in which the correction data is present and correction is made to a target pixel, and refers to the display data indicated by an image signal sent from outside in the case in which the correction data is not present.

Step S110-2

The source driver 30 according to the present embodiment writes the display data converted in step S110-1 into the target pixel.

FIG. 21 is a table showing an example of the LUT according to the present embodiment. The LUT according to the present embodiment includes rows for "normal display data" shown in FIG. 21 and rows for "converted display data" each corresponding to the aforementioned rows.

To explain the meaning of the LUT shown in FIG. 21, as an example, a case in which a luminance level at which the OLEDs emit light during characteristic detection is set as a white level (255 grayscales with 8 bits), and one horizontal scan period Thn for a non-monitoring row is four times one horizontal scan period THm for a monitoring row is considered.

Here, when the white level is set to 100%, in the monitoring row, luminance of (4 H/980 H)×100=0.408% is added to normal luminance.

In the LUT shown in FIG. 21, converted display data is generated by subtracting the addition from the normal display data.

More specifically, for example, although the display data corresponding to the 27th grayscale in FIG. 21 corresponds to 0.715 as indicated by normalized luminance, 0.307 obtained by subtracting 0.408, which is the above-described addition, from the value of 0.715 corresponds to post-conversion luminance. Then, the converted display data corresponding to the post-conversion luminance 0.307 is determined to be display data corresponding to the 18th grayscale having 0.293, which is the closest value to 0.307.

In this way, the LUT according to the present embodiment is correspondence information using the normal display data as an input value, and the data obtained by subtracting the luminance of the light emission amount in the characteristic detection step from the normal display data as an output value.

Then, in the display data writing step S110 according to the present embodiment, the source driver 30 refers to the LUT, and writes the data signal obtained by subtracting the luminance of the light emission amount n the characteristic detection step into the target pixel.

Thus, even in a case in which the characteristic detection is performed, a tine image can be displayed by the image signal input to the display device 1.

On the other hand, in the example of FIG. 21, if the characteristic detection process is performed even when the period other than a monitoring period has the 0 grayscale in grayscales of 20 or lower, light is emitted with the luminance of 0.408% and thus unnatural light emission is presented to the user. To avoid such a situation, in the characteristic detection determination process according to the present embodiment, when the value of the normal display data (i.e., the value of the data signal to be input from the image signal to the target pixel) is less than a predetermined threshold (21st grayscale in the example of FIG. 21), the characteristic detection process is skipped. Thus, unnatural light emission for the user can be curbed.

Here, the predetermined threshold described above is determined depending on how much the target pixel emits light by the characteristic detection process. In other words, the predetermined threshold described above is determined in accordance with the potential supplied to the data line S in the characteristic detection process. For example, as the luminance level at which the OLEDs emit light during the characteristic detection becomes lower, the control circuit 20 according to the present embodiment sets the predetermined threshold to be smaller accordingly.

As a result, the characteristic detection process can be suitably performed while unnatural light emission for the user is curbed.

Note that the threshold corresponds to the "threshold Lth" in step S106 illustrated in FIG. 4. Although the first embodiment has been described simply as having a predetermined threshold, in the present embodiment, the threshold Lth is adaptively determined in accordance with the potential supplied to the data line S in the characteristic detection process as described above. Thus, a configuration in which the "threshold Lth" of the first embodiment is also adaptively set as in the present embodiment is of course included in the disclosure described in the present specification.

In addition, a configuration in which the display data conversion described in the present embodiment is applied to the first embodiment is also included in the disclosure described in the present specification.

First Example of Correction Data Update Process

The control circuit 20 according to the present embodiment performs the correction data update step S112 in FIG. 4, for example, as follows.

First, in a case of a configuration in which a series of multiple characteristic detection processes are executed for the same target pixel, the control circuit 20 according to the present embodiment stores each piece of monitoring data until all of the monitoring data obtained by the series of characteristic detection processes are collected. For example, in a case in which the TFT characteristic detection process is performed two times and the OLED characteristic detection process is performed two times for the target pixel while changing the potential for the data line S, the control circuit 20 according to the present embodiment holds acquired monitoring data until acquisition of the monitoring data based on the total of four characteristic detection operations is completed, and calculates the correction data for the target pixel after all of the monitoring data for the target pixel is acquired. Then, the correction data for the target pixel is updated by supplying the calculated correction data to the storage unit 50.

With the configuration described above, the correction data can be suitably calculated.

Second Example of Correction Data Update Process

The control circuit 20 according to the present embodiment may perform the correction data update step S112 and the display data writing step S110 of FIG. 4 as follows.

In other words, in a situation in which the acquisition of two pieces of the monitoring data is completed for one element of the TFTs and the OLEDs, when, although the first monitoring data has been acquired, acquisition of the second monitoring data has been skipped for the other element, the control circuit 20 according to the present embodiment applies a compensation process based on the two pieces of monitoring data to the one element, and applies a correction process based on the monitoring data acquired before the first monitoring data to the other element.

In other words, in a situation in which the acquisition of two pieces of the monitoring data is completed for one element of the TFTs and the OLEDs for each target pixel, when the first monitoring data has been acquired but acquisition of the second monitoring data has been skipped for the other element of the TFTs and the OLEDs, the control circuit 20 according to the present embodiment writes a post-correction data potential using the correction data based on the two pieces of monitoring data for the one element and writes a post-correction data potential using the correction data based on the monitoring data acquired before the first monitoring data for the other element in the next display data writing step S110.

For example, when two pieces of monitoring data for the OLED characteristic detection has been acquired for the target pixel, the control circuit 20 calculates the correction data based on the two pieces of monitoring data for the target pixel, and writes the post-correction data potential using the correction data in the next display data writing step. On the other hand, when only one piece of monitoring data for the OLED characteristic detection has been acquired for the target pixel and the characteristic detection step S108 for acquiring the second monitoring data has been skipped, the control circuit 20 writes the post-correction data potential using the correction data based on the monitoring data acquired before the previous time in the next display data writing step without performing the calculation of new correction data and the update process of the correction data for the target pixel.

With the configuration described above, even when the characteristic detection step is skipped in the characteristic detection determination process, the data potential can be suitably corrected using the monitoring data acquired before the skip of the characteristic detection.

Example of Realization by Software

A control block (in particular, the control circuit 20) of the display device 1 may be realized by a logic circuit (hardware) formed by an integrated circuit (IC chip) or the like, or may be realized by software.

In the latter case, the display device 1 includes a computer that executes instructions of a program that is software for realizing functions. The computer includes at least one processor (control device), for example, and includes at least one computer-readable recording medium storing the program. Then, the objective of the disclosure is achieved when the processor of the computer reads and executes the program from the recording medium. A central processing unit (CPU) can be used as the processor, for example. As the recording medium, a "non-transitory tangible medium," for example, a tape, a disk, a card, a semiconductor memory, a programmable logic circuit, or the like in addition to a read only memory (ROM), or the like, can be used. Furthermore, a random access memory (RAM) into which the program is loaded or the like may be further provided. Furthermore, the program may be supplied to the computer via any transmission medium (a communication network, broadcast waves, or the like) that can transmit the program. Note that an aspect of the disclosure can also be realized in the format of data signals embedded in carrier waves, the signals realizing the program through electronic transmission.

Supplement

A drive method according to a first aspect of the disclosure is a drive method for a display device including a pixel matrix with n rows×m columns (n and m are integers greater than or equal to 2) including n×m pixel circuits, each pixel circuit includes an electro-optical element luminance of which is controlled by a current and a drive transistor configured to control a current to be supplied to the electro-optical element, the display device includes a scanning line provided for each of the rows, a monitoring line provided for each of the rows, and a data line provided for each of the columns, and the drive method is a method including a target row determination step of determining a target row to which a target pixel for which a characteristic of at least one of the drive transistor and the electro-optical element is detected belongs, a luminance calculation step of calculating a representative luminance of a pixel in the target row, and a detection determination step of performing a characteristic detection step of detecting monitoring data indicating the characteristic of at least one of the drive transistor and the electro-optical element of the pixel belonging to the target row in a case where the representative luminance is greater than or equal to a threshold, and skipping the characteristic detection step in a case where the representative luminance is less than the threshold.

According to this configuration, the effect that it is unlikely to be visually recognized light emission of OLEDs in an inspection is exhibited.

In the above-described first aspect, the drive method according to a second aspect of the disclosure may be a method in which, in the characteristic detection step, a predetermined potential is supplied to the data line, a writing step of writing a data signal into the target pixel is included after the characteristic detection step is performed, and, in the writing step, a data signal obtained by subtracting a luminance in an amount of light emission in the characteristic detection step is supplied to the target pixel.

According to this configuration, even when the characteristic detection is performed, a fine image can be displayed by the image signal input to the display device 1.

In the above-described first or second aspect, the drive method according to a third aspect of the disclosure may, in the luminance calculation step, refer to a data signal to be input from an image signal to a pixel in the target row and determine the representative luminance, and in the detection determination step, skip the characteristic detection step in a case where the representative luminance is less than the threshold.

According to this configuration, it is possible to suitably perform the characteristic detection process while curbing unnatural light emission for a user.

In any one of the first to third aspects, the drive method according to a fourth aspect of the disclosure may be configured such that the threshold may be determined in accordance with a potential supplied to the data line in the characteristic detection step.

According to this configuration, it is possible to suitably perform the characteristic detection process while curbing unnatural light emission for a user.

In any one of the first to fourth aspects, the drive method according to a fifth aspect of the disclosure may be a method in which the characteristic detection step is performed over A (A is an integer greater than or equal to 2) horizontal scan periods, a supply of a scanning signal to a scanning line in the target row is held within a period of the characteristic detection step, and a writing step of writing a data signal into the target row is included after the characteristic detection step is performed.

In any one of the first to fifth aspects, the drive method according to a sixth aspect of the disclosure may be configured such that, in the detection determination step, the characteristic detection step of detecting monitoring data indicating a characteristic of the electro-optical element is to be skipped, and the characteristic detection step of detecting monitoring data indicating a characteristic of the drive transistor is not to be skipped.

According to the configuration described above, the OLED characteristic detection is to be skipped, and the TFT characteristic detection is not to be skipped, and thus it is possible to reduce the sense of discomfort of users resulting from light emission in an inspection.

In any one of the first to sixth aspects, the drive method according to a seventh aspect of the disclosure may be a method in which, in the target row determination step, the target row is sequentially selected.

In the seventh aspect, the drive method according to an eighth aspect of the disclosure may be a method in which, in a case where the characteristic detection step for the target row is skipped in the detection determination step, the target row is set as a target row again in the next determination step.

In the eighth aspect, the drive method according to a ninth aspect of the disclosure may be a method in which, in a case where the characteristic detection step for the target row is skipped a predetermined number of times in the detection determination step, the next row of the target row is set as a target row in the next detection determination step.

According to this configuration, a situation in which the characteristic detection step is stopped in a particular row and the characteristic detection is not performed for other rows can be avoided.

In any one of the first to ninth aspects, the drive method according to a tenth aspect of the disclosure may be a method in which the detection determination step is performed on the same row as the target row over a predetermined number of multiple frames while changing a potential supplied to the data lines.

In any one of the first to ninth aspects, the drive method according to an eleventh aspect of the disclosure may be a method to perform, for consecutive frames corresponding to the number of rows included in the display device, a first process of performing the detection determination step by setting one target row per frame by shifting by one row and supplying a first potential to the data line for the target row and, after an end of the first process, for the consecutive frames corresponding to the number of rows, to perform a second process of performing the detection determination step by setting one target row per frame by shifting by one row and supplying a second potential to the data line for the target row.

In any one of the first to eleventh aspects, the drive method according to a twelfth aspect of the disclosure may be a method in which acquired monitoring data is held until acquisition of two pieces of monitoring data for the drive transistor and acquisition of two pieces of monitoring data for the electro-optical element for each target pixel are completed.

According to this configuration, correction data can be suitable calculated.

In any one of the first to eleventh aspects, the drive method according to a thirteenth aspect of the disclosure may be a method in which, in a situation in which the acquisition of the two pieces of monitoring data for at least one element of the drive transistor and the electro-optical element for each target pixel is completed, in a case where the first monitoring data is acquired for the other element, but acquisition of the second monitoring data is skipped, a compensation process based on the two pieces of monitoring data is applied to the one element, and a compensation process based on monitoring data acquired before the first monitoring data is applied to the other element.

According to this configuration, a data potential can be suitably corrected using the monitoring data obtained previously even in a case in which acquisition of the monitoring data is skipped.

In any one of the first to thirteenth aspects, the drive method according to a fourteenth aspect of the disclosure may be a method in which, in the detection determination step, the representative luminance is calculated by combining average luminances for the respective colors of pixels of the respective colors belonging to the target row with each other, and the calculated representative luminance is compared to the threshold.

In any one of the first to thirteenth aspects, the drive method according to a fifteenth aspect of the disclosure may be a method in which a different value is set for the color of each pixel as the threshold, and in the detection determination step, the representative luminance is calculated for the color of each pixel belonging to the target row, and the calculated representative luminance is compared to a threshold for a corresponding color.

In any one of the first to thirteenth aspects, the drive method according to a sixteenth aspect of the disclosure may be a method in which, in the detection determination step, the representative luminance is calculated as an average luminance of green pixels belonging to the target row, and the calculated representative luminance is compared to the threshold.

A display device according to a seventeenth aspect of the disclosure is a display device including a pixel matrix with n rows×m columns (n and m are integers greater than or equal to 2) including n×m pixel circuits, each pixel circuit including an electro-optical element luminance of which is controlled by a current and a drive transistor configured to control a current to be supplied to the electro-optical element, the display device including a scanning line provided for each of the rows, a monitoring line provided for each of the rows, a data line provided for each of the columns, and a controller, and the controller is configured to determine a target row to which a target pixel for which a characteristic of at least one of the drive transistor and the electro-optical element is detected belongs, calculate a representative luminance of a pixel in the target row, and perform a characteristic detection step of detecting monitoring data indicating a characteristic of at least one of the drive transistor and the electro-optical element of the pixel belonging to the target row in a case where the representative luminance is greater than or equal to the threshold, and skipping the characteristic detection step in a case where the representative luminance is less than the threshold.

The disclosure is not limited to each of the embodiments described above, various modifications may be made within the scope of the claims, and an embodiment obtained by appropriately combining technical approaches disclosed in each of the different embodiments also falls within the technical scope of the disclosure. Moreover, novel technical features can be formed by combining the technical approaches disclosed in the embodiments.

The invention claimed is:

1. A drive method of a display device including a pixel matrix with n rows×m columns (n and m are integers greater than or equal to 2) including n×m pixel circuits, each pixel circuit including an electro-optical element luminance of which is controlled by a current and a drive transistor configured to control a current to be supplied to the electro-optical element, and the display device including a scanning line provided for each of the rows, a monitoring line provided for each of the rows, and a data line provided for each of the columns, the drive method comprising: a target row determination step of determining a target row to which a target pixel for which a characteristic of at least one of the drive transistor and the electro-optical element is detected belongs; a luminance calculation step of calculating a representative luminance of a pixel in the target row, and a detection determination step of performing a characteristic detection step of detecting monitoring data indicating the characteristic of at least one of the drive transistor and the electro-optical element of the pixel belonging to the target row in a case where the representative luminance is greater than or equal to a threshold, and skipping the characteristic detection step in a case where the representative luminance is less than the threshold; wherein in the detection determination step, in a case where the characteristic detection step for the tarqet row is skipped, the target row is set as a target row again in the next determination step.

2. The drive method according to claim 1, wherein, in the characteristic detection step, a predetermined potential is supplied to the data line, a writing step of writing a data signal into the target pixel is included after the characteristic detection step is performed, and in the writing step, an adjusted data signal obtained by subtracting a luminance in an amount of light emission in the characteristic detection step is supplied to the target pixel.

3. The drive method according to claim 1, wherein, in the luminance calculation step, a data signal to be input from an image signal to a pixel in the target row is referred to and the representative luminance is determined, and in the detection determination step, the characteristic detection step is skipped in a case where the representative luminance is less than the threshold.

4. The drive method according to claim 1, wherein the threshold is determined in accordance with a potential supplied to the data line in the characteristic detection step.

5. The drive method according to claim 1, wherein the characteristic detection step is performed over A (A is an integer greater than or equal to 2) horizontal scan periods, a supply of a scanning signal to a scanning line in the target row is held within a period of the characteristic detection step, and a writing step of writing a data signal into the target row is included after the characteristic detection step is performed.

6. The drive method according to claim 1, wherein, in the detection determination step, the characteristic detection step of detecting monitoring data indicating a characteristic of the electro-optical element is to be skipped, and the characteristic detection step of detecting monitoring data indicating a characteristic of the drive transistor is not to be skipped.

7. The drive method according to claim 1, wherein, in the target row determination step, the target row is sequentially selected.

8. The drive method according to claim 1, wherein, in the detection determination step, in a case where the characteristic detection step for the target row is skipped a predetermined number of times, the next row of the target row is set as a target row in the next determination step.

9. The drive method according to claim 1, wherein the detection determination step is performed on the same row as the target row over a predetermined number of multiple frames while changing a potential supplied to the data line.

10. The drive method according to claim 1, wherein, for consecutive frames corresponding to the number of rows included in the display device, a first process of performing the detection determination step by setting one target row per frame by shifting by one row and supplying a first potential to the data line for the target row is performed, and after an end of the first process, for the consecutive frames corresponding to the number of rows, a second process of performing the detection determination step by setting one target row per frame by shifting by one row and supplying a second potential to the data line for the target row is performed.

11. The drive method according to claim 1, wherein acquired monitoring data is held until acquisition of two pieces of monitoring data for the drive transistor and acquisition of two pieces of monitoring data for the electro-optical element for each target pixel are completed.

12. The drive method according to claim 1, wherein, in a situation in which acquisition of two pieces of monitoring data for at least one element of the drive transistor and the electro-optical element for each target pixel is completed, in a case where first monitoring data is acquired for the other element, but acquisition of second monitoring data is skipped, a compensation process based on the two pieces of monitoring data is applied to the one element, and a correction process based on monitoring data acquired before the first monitoring data is applied to the other element.

13. The drive method according to claim 1, wherein, in the detection determination step, the representative luminance is calculated by combining average luminances for the respective colors of pixels of the respective colors belonging to the target row with each other, and the calculated representative luminance is compared to the threshold.

14. The drive method according to claim 1, wherein a different value is set for the color of each pixel as the threshold, and in the detection determination step, the representative luminance is calculated for the color of each pixel belonging to the target row, and the calculated representative luminance is compared to a threshold for a corresponding color.

15. The drive method according to claim 1, wherein, in the detection determination step, the representative luminance is calculated as an average luminance of green pixels belonging to the target row, and the calculated representative luminance is compared to the threshold.

16. A display device including a pixel matrix with n rows×m columns (n and m are integers greater than or equal to 2) including n×m pixel circuits, each pixel circuit including an electro-optical element luminance of which is controlled by a current and a drive transistor configured to control the current to be supplied to the electro-optical element, the display device comprising: a scanning line provided for each of the rows; a monitoring line provided for each of the rows; a data line provided for each of the columns; and a controller, wherein the controller is configured to determine a target row to which a target pixel for which a characteristic of at least one of the drive transistor and the electro-optical element is detected belongs, calculate a representative luminance of a pixel in the target row, and perform a characteristic detection step of detecting monitoring data indicating the characteristic of at least one of the drive transistor and the electro-optical element of the pixel belonging to the target row in a case where the representative luminance is greater than or equal to the threshold, and skipping the characteristic detection step in a case where the representative luminance is less than the threshold; wherein in the detection determination step, in a case where the characteristic detection step for the target row is skipped, the tarqet row is set as a tarqet row aqain in the next determination step.

* * * * *